US007070898B2

(12) United States Patent
Nakamura et al.

(10) Patent No.: US 7,070,898 B2
(45) Date of Patent: Jul. 4, 2006

(54) TONER

(75) Inventors: Tatsuya Nakamura, Shizuoka (JP); Kenji Okado, Ibaraki (JP); Akira Hashimoto, Shizuoka (JP); Keiji Komoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 10/726,503

(22) Filed: Dec. 4, 2003

(65) Prior Publication Data

US 2004/0191659 A1 Sep. 30, 2004

(30) Foreign Application Priority Data

Dec. 4, 2002 (JP) ..... 2002-352032

(51) Int. Cl.
*G03G 9/08* (2006.01)

(52) U.S. Cl. ..... 430/108.8; 430/110.3; 430/110.4; 430/137.15

(58) Field of Classification Search ..... 430/108.8, 430/110.3, 110.4, 137.15
See application file for complete search history.

(56) References Cited

U.S. PATENT DOCUMENTS

| | | | | |
|---|---|---|---|---|
| 4,301,355 | A | 11/1981 | Kimbrough et al. | 219/137 PS |
| 4,578,338 | A | 3/1986 | Gruber et al. | 430/120 |
| 4,810,612 | A | 3/1989 | Ueda et al. | 430/109 |
| 4,921,771 | A | 5/1990 | Tomono et al. | 430/110 |
| 4,988,598 | A | 1/1991 | Tomono et al. | 430/99 |
| 4,990,424 | A | 2/1991 | Van Dusen et al. | 430/106.6 |
| 5,714,993 | A | 2/1998 | Keoshkerian et al. | 347/95 |
| 5,741,617 | A | 4/1998 | Inaba et al. | 430/110 |
| 5,741,618 | A | 4/1998 | Shigemori et al. | 430/137 |
| 6,002,903 | A | 12/1999 | Hayase et al. | 399/279 |
| 6,458,502 | B1 * | 10/2002 | Nakamura et al. | 430/137.17 |

FOREIGN PATENT DOCUMENTS

| | | |
|---|---|---|
| EP | 0826697 A2 | 3/1998 |
| JP | 52-3304 | 1/1977 |
| JP | 52-3305 | 1/1977 |
| JP | 56-13945 | 4/1981 |
| JP | 57-52574 | 3/1982 |
| JP | 60-217366 | 10/1985 |
| JP | 60-252360 | 12/1985 |
| JP | 60-252361 | 12/1985 |
| JP | 61-94062 | 5/1986 |
| JP | 61-138209 | 6/1986 |
| JP | 61-273554 | 12/1986 |
| JP | 62-14166 | 1/1987 |
| JP | 1-109359 | 4/1989 |
| JP | 2-79860 | 3/1990 |
| JP | 3-50559 | 3/1991 |
| JP | 5-341573 | 12/1993 |
| JP | 10-20548 | 1/1998 |
| JP | 11-202553 | 7/1999 |

* cited by examiner

*Primary Examiner*—John L Goodrow
(74) *Attorney, Agent, or Firm*—Fitzpatrick, Cella, Harper & Scinto

(57) ABSTRACT

A toner having a favorable fixability, excelling in charge stability, and capable of forming a image of retaining a high image density and a high resolution in long-term use is provided. That is, the toner of the present invention is a toner obtained by polymerizing a polymerizable monomer composition comprising a polymerizable monomer and a colorant, in which the polymerizable monomer composition is polymerized using a polymerization initiator comprising a redox initiator which includes an organic peroxide with a 10-hour half-life temperature of 86° C. or higher and an reducing agent; the toner has a ratio of a weight-average particle diameter to a number-average particle diameter of 1.40 or less; and the toner has top of a main-peak in a molecular weight range of 5,000 to 50,000 in a molecular weight distribution measured using GPC of the THF-soluble part thereof, including t-butanol with a content of 0.1 to 1,000 ppm.

13 Claims, 8 Drawing Sheets

CROSS SECTION OF TONER PARTICLE

TONER

BACKGROUND OF THE INVENTION

1. Field of the Invention

The present invention relates to a toner used in an image forming method such as electrophotography, electrostatic recording, magnetic recording, toner jet recording, etc.

2. Description of the Related Art

The various electrophotographic methods have been known. In general, a photoconductive material is used to form an electrostatic latent image on an electrostatic latent image bearing member (hereinafter, also referred to as "photosensitive member") by a variety of methods, followed by developing the latent image with a toner as a developer to a visualized image, i.e., toner image. If necessary, the toner image is transferred onto a recording medium such as paper and then fixed onto the recording medium through heat or pressure application etc. to obtain a copy.

An image forming apparatus adopting such an image forming method includes a copying machine or printer, for example.

In recent years, an LED or LBP printer has got a major share of the printers on the market. Regarding its technical direction, the printer with a more high resolution is being demanded. In other words, the conventional printers with the resolution of 240 or 300 dpi are now replaced by printers with the higher resolution of 600, 800, or 1200 dpi. Accordingly, a developing process is demanded to realize a high definition for the high-resolution printers. Also, in the field of copying machines, the function thereof is advanced. Thus, digitalization thereof is being in progress. Such digital copying machines mainly adopt a method of forming the electrostatic latent, image with a laser and thus, there is a growing tendency for the copying machines to pursue the higher resolution. Further, along with an increased image quality, it is greatly required to attain a higher-speed response and a longer service life of the image forming apparatus.

In a developing method adopted for the above printers or copying machines, the toner image formed on the photosensitive member in a developing step is transferred onto the recording medium in a transfer step. At this time, a transfer residual toner remaining on the photosensitive member in an image area and a fog toner in a non-image area are cleaned in a cleaning step and stored in a waste toner container. Up to now, the cleaning step has been performed through blade cleaning, fur brush cleaning, roller cleaning, etc. From the viewpoint of apparatus structure, provision of a cleaning device therefor inevitably makes the apparatus large to inhibit downsizing of the apparatus. In addition, from an ecological point of view, a system with less waste toner is demanded for making effective use of the toner. Therefore, the toner high in transfer efficiency with less fogging is required.

From a viewpoint of downsizing a device, a one-component developing method is preferable because it does not require carrier particles such as glass beads or iron powder necessary for a two-component developing method so that a developing device itself can be small-sized and lightly-weighed. Further, the two-component developing method requires a device that detects a toner concentration and replenishes a necessary amount of the toner in order to maintain a constant toner concentration in a developer; therefore, the developing device becomes large and heavy. On the other hand, the one-component developing method does not require such devices, thus allowing a small-sized and lightweight developing device, and is preferable.

Further, space-saving, cost reduction, and lowering of power consumption resulting from a miniaturization of a copying machine or printer have become extremely important objects recently, and the miniaturization or a simplification of a device and a device with low power consumption are required for a fixing device.

On the other hand, a toner is generally produced through a pulverization process, in which a binder resin, a colorant, or the like, are melt-kneaded, uniformly dispersed, pulverized by a pulverizer, and classified by a classifier to obtain toner particles of a desired particle size. According to the pulverization process, however, the range of material selection is restricted if toner particle size reduction is intended. For example, a colorant dispersing resin must be sufficiently fragile and must be finely pulverized by an economically feasible production apparatus. As a result of providing a fragile colorant dispersing resin to meet such a requirement, when the colorant dispersing resin is actually pulverized at high-speed, it is liable to result in formation of particles of a broad particle size range. A fine particle (excessively pulverized particles) particularly forms in a relatively large proportion while a magnetic powder or a colorant is liable to detach from the resin during pulverization. Moreover, a toner of such a highly fragile material is liable to be further pulverized or powdered during its use as a developer toner in a copying machine or the like.

Further, in the pulverization process, it is difficult to completely uniformly disperse solid fine particles such a magnetic powder or a colorant into a resin, and depending on a degree of dispersion, the dispersion may become a cause of an increase of fogging and lowering of image density.

Thus, the pulverization process essentially poses a limit in production of small-size fine toner particles required for high resolution and high-quality images, as it is accompanied with significant deterioration of powder properties (particularly uniform chargeability and flowability of the toner).

In order to overcome the problems of the toner produced by the pulverization process and to meet such requirements as mentioned above, the production of a toner through a polymerization process is proposed.

A toner produced by a suspension polymerization (hereinafter referred to as "polymerization toner") is produced by: dissolving or dispersing uniformly a polymerizable monomer, a colorant, a polymerization initiator, and if required, a crosslinking agent, a charge control agent, and other additives to prepare a monomer composition; and dispersing the monomer composition in a medium (aqueous phase, for example) containing a dispersion stabilizer using an appropriate agitator, and simultaneously conducting a polymerization reaction, to thereby obtain a toner particle of a desired particle diameter. In this process, a pulverization step is simply not included; therefore, fragility of the toner is not required, and a soft material can be used as a resin. In addition, there is an advantage that an exposure of a colorant to a particle surface is prevented, and a toner having a uniform triboelectric chargeability can be obtained. Further, a particle diameter distribution of the obtained toner is relatively sharp, so that a classification step may be omitted. When conducting the classification after the production of the polymerization toner, the toner can be obtained in a higher yield. The toner obtained by the polymerization process has a spherical shape; therefore, it excels in flowability and transferability and is advantageous for a high-quality image.

Up to now, in a fixing step where the toner is fixed onto a recording medium, a fixing roller surface of a material (such as a silicone rubber or a fluororesin) showing good releasability with respect to the toner is generally formed to prevent the toner from attaching onto the fixing roller surface, and in addition, the roller surface is coated by a thin film of a liquid showing good releasability such as a silicone oil and a fluorine oil to prevent an offset phenomenon of the toner and also fatigue of the fixing roller surface. The above method is very effective for preventing the offset phenomenon of the toner, but is accompanied with difficulties such that: the requirement of a device that supplies the offset-preventing liquid results in complication of the fixing device; and the applied oil induces peeling between the layers constituting the fixing roller and thus, shortens the life of the fixing roller.

Accordingly, based on a concept of not using such a silicone oil-supplying device but supplying an offset-preventing liquid from toner particles on heating, it has been proposed to incorporate a wax, such as low-molecular weight polyethylene or low-molecular weight polypropylene within toner particles.

It is known to incorporate a wax into toner particles as a wax. For example, Japanese Examined Patent Publication No. Sho 52-3304, and No. Sho 52-3305 and Japanese Patent Application Laid-open No. Sho 57-52574 disclose such techniques.

Further, Japanese Patent Applications Laid-open No. Hei 03-50559, No. Hei 02-79860, No. Hei 01-109359, No. Sho 62-14166, No. Sho 61-273554, No. Sho 61-94062, No. Sho 61-138259, No. Sho 60-252361, No. Sho 60-252360 and No. Sho 60-217366 disclose techniques by which a wax is incorporated into toner particles.

A wax is used for the purpose of improving anti-offset properties at the time of low-temperature fixing or high-temperature fixing of toners or improving fixability at the time of low-temperature fixing. On the other hand, a wax tends to cause lowering of anti-blocking property of a toner, lowering of developability because of a temperature rise in copying machines or printers, or lowering of developability because of a migration of the wax toward toner particle surfaces when the toner is left to stand under high-temperature and high-humidity conditions for a long term.

As a countermeasure for the above problems, toners produced by suspension polymerization are proposed. For example, according to the disclosure in Japanese Patent Application Laid-open No. Hei 05-341573, a polar component is added to a monomer composition in an aqueous dispersion medium, where components having polar groups contained in the monomer composition tend to become present at a surface layer portion which is an interface with an aqueous phase. Non-polar components hardly exist at the surface layer portions; therefore, toner particles can have core/shell structures.

As a result, the produced toner achieves both the anti-blocking property and the high-temperature anti-offset properties that conflict with each other by encapsulating the wax in toner particles, and can prevent the high-temperature offset without applying any wax such as oil to fixing rollers.

However, for the low-temperature fixing, the speed of migration of a wax at a core part of the toner having a core/shell structure to a toner surface layer upon the fixing operation is an important object.

Further, as disclosed in Japanese Patent Application Laid-open No. Hei 11-202553, a production method of the polymerization toner is proposed, including: conducting a suspension polymerization under the presence an oil-soluble polymerization initiator; and adding a reducing agent for a redox initiator to thereby combine the low-temperature fixing and anti-blocking properties.

Further, Japanese Patent Application Laid-open No. Hei 10-20548 proposes a polymerization polymer in which a formation of residual monomer or the like is suppressed and which has little odor by using a specific polymerization initiator. However, the proposed toners are not sufficient in low-temperature fixability.

SUMMARY OF THE INVENTION

An object of the present invention is to provide a toner having solved the problems of the prior art described above.

In other words, an object of the present invention is to provide a toner exhibiting a favorable fixability, excelling in charge stability, having a high image density in long-term use, and providing a high-resolution image.

The present invention provides a toner obtained by polymerizing a polymerizable monomer composition comprising at least a polymerizable monomer and a colorant using an organic peroxide with a 10-hour half-life temperature of 86° C. or higher and a reducing agent as a redox initiator, in which:

a ratio of a weight-average particle diameter to a number-average particle diameter (a weight-average particle diameter/a number-average particle diameter) of the toner is 1.40 or less; and the toner has a top of a main-peak in a range of 5,000 to 50,000 in a molecular weight distribution measured by a gel permeation chromatography (GPC) of a THF soluble part thereof; and the toner contains 0.1 to 1,000 ppm of t-butanol.

BRIEF DESCRIPTION OF THE DRAWINGS

Other objects and advantages of the present invention will become apparent during the following discussion conjunction with the accompanying drawings, in which.

DETAILED DESCRIPTION OF THE PREFERRED EMBODIMENTS

Figure 1:
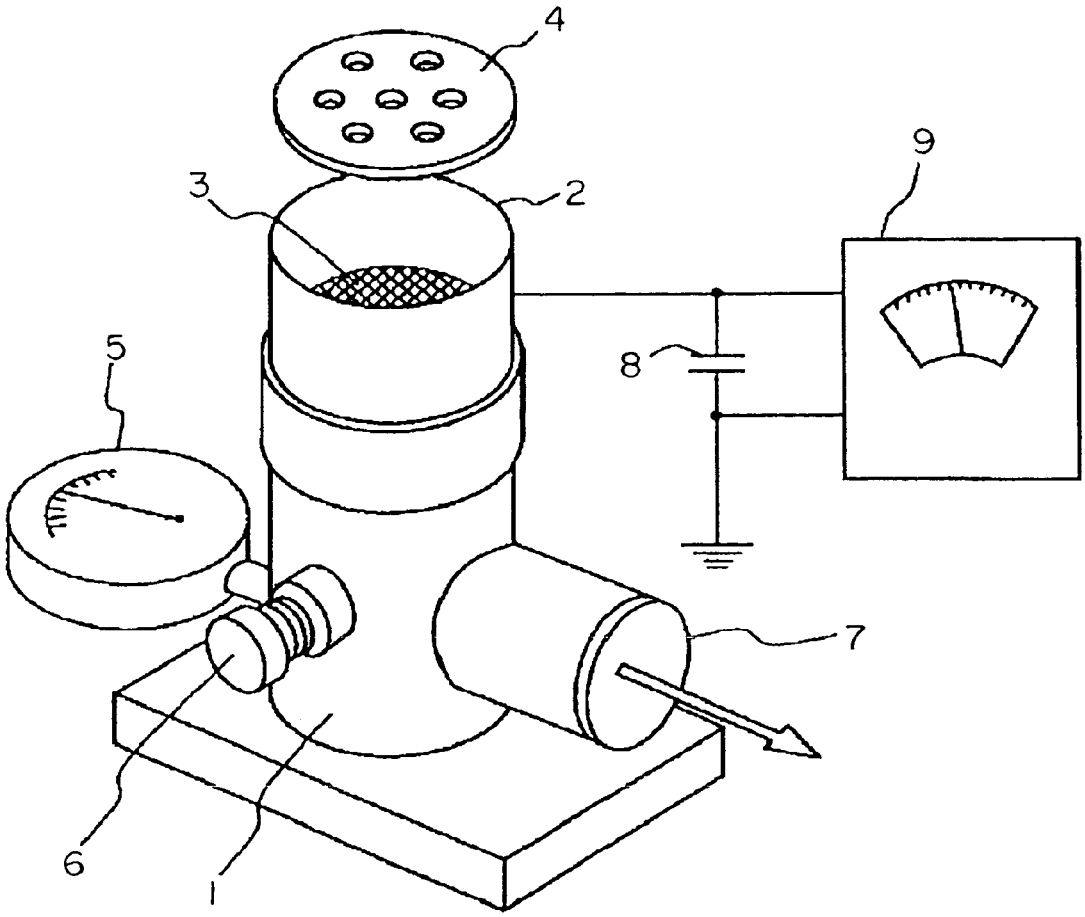
FIG. 1 is a schematic explanatory diagram of a device for measuring a triboelectrification amount of a toner.

The inventors of the present invention, devoting themselves to a comprehensive study, have found that including a trace amount of t-butanol in a toner is effective for a wax present inside the toner to instantaneously migrate toward the toner surface at the process of fixing. The reason for t-butanol to be effective is that since a melting point thereof is close to a room temperature, about 26° C., t-butanol works as a plasticizer by melting instantaneously at the process of fixing, enabling easy migration of the wax to the toner surface.

According to the present invention, t-butanol content in the toner is preferably 0.1 to 1,000 ppm, more preferably 0.1 to 200 ppm. When the content is less than 0.1 ppm, the above effect becomes insufficient.When the content exceeds 1,000 ppm, an anti-blocking property and flowability are liable to deteriorate under high-temperature and high-humidity conditions and a toner fusion to a charging member or a photosensitive member is liable to occur.

The t-butanol content in the toner of the present invention can be easily measured by a gas chromatography, preparing a calibration curve and using an internal standardization.

Further, it is preferable that an average circularity of the toner is 0.970 or more. The closer a toner to a spherical shape, more likely t-butanol is to migrate evenly to the whole toner surface. It is therefore considered that the wax in the toner also migrates evenly to the whole surface efficiently. Further, a transferability of the toner becomes exceedingly favorable. When the average circularity does not reach 0.970, the above effects may become insufficient.

Further, the toner of the present invention preferably has a mode circularity of 0.99 or more in a circularity distribution. A mode circularity of 0.99 or more means that much of the toner particles possess a shape close to a sphere, and the toner can further exert the above effects notably and therefore is preferable.

The average circularity according to the present invention is adapted to simply express a particle shape in a quantitative manner. In the present invention, using a flow-type particle image analyzer ("FPIA-1000" manufactured by TOA Medical Electronics Co., Ltd.), a circularity (Ci) of each particle (particles having a equivalent circle diameter of 3 μm or more) is determined according to the following equation (1). Further, a value determined by dividing the sum of measured circularity values of total particles with a total particle number (m) is defined as an average circularity (C) as represented by the following equation (2).

$$\text{Circularity } (Ci) = (\text{circumference of a circle having an area identical to that of a projected particle image})/(\text{circumferential length of the projected particle image}) \quad (1)$$

$$\text{Average circularity } (C) = \sum_{i=1}^{m} Ci/m \quad (2)$$

Further, the mode circularity is determined as follows. The measured circularity values of each of the toner particles is allotted to 61 classes by 0.01 in a circularity range of 0.40 to 1.00. Then, the circularity of a class with the highest frequency in a circularity frequency distribution is defined as the mode circularity.

Here, the measuring device "FPIA-1000" used in the present invention calculates the average circularity and the mode circularity by the following method. That is, the calculated circularity values of each of the particles, for calculation of the average circularity and the mode circularity, are divided into 61 classes in the circularity range of 0.40 to 1.00. The average circularity and the mode circularity are determined using a central value of circularity of each class and the frequency of particles of the class. However, each of the average circularity and mode circularity values thus calculated by the above calculation method and each of the average circularity and mode circularity values obtained according to the equations (1) and (2) using the above circularity values of each particle have a miniscule difference, substantially negligible. Therefore, for data processing such as shortening the calculation time and simplifying the calculation of operation expressions, using the idea of equations which directly adopt the above circularity values of each of the particles, a modified such calculation method may be used.

The measurement procedures are as follows.

Into 10 ml of water containing about 0.1 mg of surfactant dissolved, about 5 mg of a toner is dispersed to prepare dispersion, and the dispersion is subjected to an application of an ultrasonic wave (20 kHz, 50 W) for 5 minutes. A sample dispersion containing 5,000 to 20,000 particles/μl is measured using the device mentioned above to determine the average circularity and mode circularity with respect to particles having an equivalent circle diameter of 3 μm or more.

The average circularity used herein is an indicator of unevenness of toner shape. A circularity of 1.000 means that the toner particles have a shape of a perfect sphere, and a small average circularity represents a complex surface shape of the toner.

Herein, in this measurement, only particles having a equivalent circle diameter of 3 μm or more are measured for the circularity for the following reason. Particles having the equivalent circle diameter of smaller than 3 μm include a substantial amount of particles of external additives present independent from the toner particles. If such particles with small equivalent circle diameter are included among measuring object, through its influence, estimation of accurate circularity of the toner particles is inhibited.

Further, it is important in the toner of the present invention that a ratio (D4/D1) of a weight-average particle diameter (D4) to a number-average particle diameter (D1) is 1.40 or less, and preferably 1.35 or less.

A ratio of a weight-average particle diameter to a number-average particle diameter of more than 1.40 means that a substantial number of fine particles exist in the toner and that contact points between the toner particles increase. As a result, the anti-blocking property and flowability tend to deteriorate under high temperature and high humidity environment, and the above is not preferable.

Here, the average particle diameter and a particle diameter distribution can be measured by various methods using Coulter Counter TA-II model, Coulter Multisizer (manufactured by Coulter Inc.), or the like. In the present invention, the measurement is performed using the Coulter Multisizer (manufactured by Coulter Inc.), and connecting it to an interface (manufactured by Nikkaki K.K.) and a personal computer ("PC9801", manufactured by NEC Corporation) which output a number-basis distribution and a volume-basis distribution. Here, a 1% NaCl aqueous solution prepared using a reagent grade sodium chloride is used as an electrolytic solution. For such an electrolytic solution, ISOTON R-II (available from Coulter Scientific Japan K.K.), for example, can be used.

The measurement is performed as follows. Into 100 to 150 ml of the aqueous electrolytic solution, 0.1 to 5 ml of a surfactant, preferably an alkylbenzenesulfonate is added as a dispersant, and 2 to 20 mg of a measurement sample is further added thereto. The resultant electrolytic solution containing a suspended sample is subjected to dispersion treatment for about 1 to 3 minutes by an ultrasonic disperser. Then, the solution is subjected to a measurement of volume and number of the toner particles having a particle diameter of 2 μm or more using the above-mentioned Coulter Multisizer with a 100 μm-aperture to calculate the volume-basis distribution and the number-basis distribution. From the volume-basis distribution, the volume-based weight-average particle diameter (D4) of the toner, and from the number-basis distribution, a number-based length-average particle diameter, that is, the number-average particle diameter of the toner (D1) are calculated. The same calculation was performed for examples described later.

In order to form a higher quality image faithfully developing minuter latent image dots, the toner of the present invention has a weight-average particle diameter of preferably 3 to 10 μm, more preferably 4 to 9 μ. With a toner having a weight-average particle diameter of less than 3 μm, in addition to the increase in total surface area of the toner, flowability and agitating property as a powder deteriorate, and uniform charging of the individual toner particles becomes difficult. Therefore, fogging and transferability tend to worsen, easily causing an image irregularity, which is not preferable. If the weight-average particle diameter of the toner exceeds 10 μm, toner scattering is liable to occur on character or line images, resulting in difficulties in obtaining a high-resolution image. In an image forming apparatus pursuing a higher resolution, a dot-reproducibility of a toner of a weight-average particle diameter of 10 μm or more tends to deteriorate.

The toner of the present invention preferably contains a wax for improving fixability. The toner contains the wax in preferably 1 to 30% by mass, more preferably 3 to 25% by mass with respect to the binder resin. With the wax content below 1% by mass, the addition effect of the wax is not sufficient, and an offset-preventing effect becomes insufficient. On the other hand, with the wax content above 30% by mass, a storage stability of the toner for a long period deteriorates along with an impairment of dispersibility of other toner materials such as a colorant, leading to inferior coloring ability of the toner and degraded image properties. Further, the migration of the wax becomes liable to occur, and durability in a high temperature, high humidity environment deteriorates. Moreover, the toner shape tends to be irregular because it contains much wax.

Examples of a wax usable in the toner of the present invention may include: petroleum waxes such as a paraffin wax, a microcrystalline wax, and petrolactum and derivatives thereof; a montan wax and derivatives thereof; a hydrocarbon wax by Fischer-Tropsch process and derivatives thereof; polyolefin waxes as represented by a polyethylene wax and derivatives thereof; and natural waxes such as a carnauba wax and a candelilla wax and derivatives thereof. The derivatives may include oxides, block copolymers with vinyl monomers, and graft-modified products. Further examples may include: higher aliphatic alcohols; fatty acids such as a stearic acid and a palmitic acid and compounds thereof; an acid amide wax, an ester wax, ketones, a hardened castor oil and derivatives thereof; vegetable waxes; and animal waxes.

Among those waxes, it is preferred to use a wax having an endothermic peak of a differential thermal analysis in a temperature range of 40 to 150° C. In other words, the wax having a maximum endothermic peak in a temperature range of 40 to 150° C. in a DSC curve measured with a differential scanning calorimeter during a temperature rise is preferable, and the one in a temperature range of 50 to 100° C. is more preferable. Having a maximum endothermic peak in the above temperature range, combined with including t-butanol in the toner, greatly contributes to low-temperature fixing while effectively exhibiting releasability. If the maximum endothermic peak is at a temperature below 40° C., a self-cohesion of the wax component weakens, resulting in poor high-temperature offset-resisting properties. Further, migration of the wax becomes liable to occur from the toner, and a charge amount of the toner decreases while durability under high-temperature, high-humidity environment degrades. If the maximum endothermic peak exceeds 150° C., an effect of t-butanol cannot be exerted sufficiently, a fixing temperature becomes higher, and low temperature offset is liable to occur. Accordingly, such wax is not preferable. Also, in a case of directly producing the toner through the polymerization process by conducting granulation and polymerization in an aqueous medium, if the maximum endothermic peak is at a high temperature, problems may occur undesirably such that the wax component may separate during granulation, and granulation property of the toner particles tends to deteriorate. Therefore, an endothermic peak at a high temperature is not preferable.

An endotherm and the maximum endothermic peak temperature of the wax measured using differential scanning calorimeter are measured according to "ASTM D3418-8". For the measurement, for example, DSC-7, manufactured by Perkin-Elmer Inc. is used. The temperature at a detecting portion of the device is corrected based on melting points of indium and zinc, and the calorie is corrected based on heat of fusion of indium. A measurement sample is put in a pan made of aluminum, and an empty pan is set as a control. After heating the sample to 200° C. once to remove a thermal history, the sample is quenched and then reheated in a temperature range of 30 to 200° C. at a temperature increase rate of 10° C./min to obtain a DSC curve. The same measurements were performed for examples described later, and the maximum endothermic peak temperatures were used as melting points of the waxes.

The toner of the present invention has, in its molecular-weight distribution of a THF-soluble part measured by a gel permeation chromatography (GPC), a top of a main-peak in a region of preferably 5,000 to 50,000, more preferably, 8,000 to 40,000. Having a peak in the above molecular weight range, combined with including t-butanol in the toner, greatly contributes to low-temperature fixing while effectively exhibiting releasability. If the toner has a top of a main-peak molecular weight below 5,000, the migration of the wax from the toner is liable to occur, a problem may arise in storage stability of the toner, and the toner significantly degrades when printing out many sheets. On the other hand, if the toner has a top of a main-peak above 50,000, the effect of adding t-butanol to the toner cannot be exerted sufficiently, fixing temperature may become higher, and low temperature off-set is liable to occur undesirably. The measurement of the molecular-weight distribution of the THF-soluble resin component (the THF-soluble part) using GPC can be performed in the following way.

A solution, dissolving a toner in THF by leaving at rest for 24 hours at a room temperature, is filtrated through a solvent-resistant membrane filter of pore size of 0.2 μm to prepare a sample solution to be measured according to the following conditions. For a sample preparation, an amount of THF is adjusted so that a concentration of a THF-soluble part is set to be in a range of 0.4 to 0.6% by mass.

Conditions for measuring the molecular-weight distribution of the THF-soluble part in the toner using GPC are as follows.

GPC apparatus: high-speed GPC, HPLC8120GPC, (manufactured by Tosoh Corporation)

Column: 7 serial columns of Shodex KF-801, 802, 803, 804, 805, 806, and 807 (available from Showa Denko K.K.)

Eluent: THF

Flow rate: 1.0 ml/min

Temperature of the oven: 40.0° C.

Sample injection amount: 0.10 ml

Further, for calculating the molecular weight of the sample, a molecular weight calibration curve was used which was prepared using standard polystyrene resins, TSK Standard Polystyrenes (F-850, F-450, F-288, F-128, F-80, F-40, F-20, F-10, F-4, F-2, F-1, A-5000, A-2500, A-1000 or A-500, available from Tosoh Corporation).

A molecular weight of the toner can be arbitrarily changed by a combination of a kind, an amount, etc. of an initiator or a crosslinking agent used for polymerizing a polymerizable monomer composition. Further, the molecular weight can be adjusted using a chain transfer agent or the like.

The toner of the present invention has a feature in that the toner is obtained by polymerizing a polymerizable monomer composition comprising at least a polymerizable monomer and a colorant using a redox initiator, containing an organic peroxide with a 10-hour half-life temperature of 86° C. or higher and a reducing agent, as a polymerization initiator.

When using an organic peroxide with a 10-hour half-life temperature below 86° C. combined with a reducing agent, as the redox initiator, obtaining a molecular weight of the toner required in the present invention becomes difficult because the organic peroxide is too reactive to control. Such an organic peroxide is preferably selected from the group consisting of t-butylhydroperoxide (10-hour half-life temperature of 166.5° C.), di-t-butylperoxide (10-hour half-life temperature of 123.7° C.), and t-butylperoxy isopropyl monocarbonate (10-hour half-life temperature of 98.7° C.).

It is considered that the organic peroxides mentioned above decompose and a part thereof produces t-butanol through a hydrogen abstraction reaction, resulting in more uniform dispersion of t-butanol in the binder resin of the toner.

Further, a reducing agent used in the present invention is preferably an organic compound not containing a sulfur atom or a nitrogen atom, more preferably ascorbic acid or an ascorbate.

When an organic compound containing a sulfur atom or a nitrogen atom remains in the toner, chargeability of the toner tends to deteriorate. Specifically for a negatively charged toner, an organic compound containing a nitrogen atom which remains in the toner is undesirable from a viewpoint of chargeability.

The ascorbic acid or the ascorbate is preferably used as a reducing agent. The ascorbic acid and the ascorbate are easily removed because they are water soluble, and effect can be obtained as a dispersion stabilizer during polymerization reaction in an aqueous medium.

A glass transition temperature (Tg) of the toner is preferably 40 to 80° C., and more preferably 45 to 70° C. If Tg is below 40° C., a storage stability of the toner degrades, and if above 80° C., fixability becomes inferior. A measurement of the glass transition temperature of the toner is performed using a highly precise, inner-heat input compensation type differential scanning calorimeter (DSC) (e.g., "DSC-7", manufactured by Perkin-Elmer Inc.) according to "ASTM D3418-8". In the present invention, after heating a sample once to remove a thermal history, the sample is quenched and then reheated in a temperature range of 30 to 200° C. at a temperature increase rate of 10° C./min to obtain a DSC curve.

It is also possible to produce the toner of the present invention according to a method of using a disk or a multi-fluid nozzle to spray a melt-mixture into the air to form a spherical toner as disclosed in Japanese Examined Patent Publication No. Sho 56-13945; a dispersion polymerization method of directly producing a toner through polymerization using an aqueous organic solvent in which a monomer is soluble but the resultant polymer is insoluble; or an emulsion polymerization method as represented by a soap-free polymerization method in which a toner is directly produced by polymerization in presence of a water-soluble polar polymerization initiator. However, as described above, in order to obtain a toner with an average circularity of 0.970 or more to be preferably used in the present invention, a mechanical, thermal, or specific treatment of some kind is required after polymerization, leading to decrease of productivity.

Therefore, in the present invention, it is particularly preferable that the toner is produced by a suspension polymerization.

In the following, a production method of the toner by the suspension polymerization preferably used in the present invention is described. Generally, a toner composition can be produced by.accordingly adding a colorant, a wax, a plasticizer, a charge control agent, a crosslinking.agent, and optionally essential components for a toner such as a magnetic powder and other additives, for example, a polymer, a dispersant, or the like to a polymerizable monomer serving as a binder resin. The toner can be produced by suspending a polymerizable monomer composition, prepared by uniformly dissolving or dispersing the above ingredients (the toner composition) by a dispersing machine or the like in an aqueous medium containing a dispersion stabilizer, and polymerizing using a polymerization initiator.

Examples of a polymerizable monomer constituting the polymerizable monomer composition used for producing the toner of the present invention include the following.

Examples of the polymerizable monomer may include: styrene monomers such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and monomers such as acrylonitrile, methacrylonitrile, and acrylamide. These monomers can be used singly or in mixture. Among these, styrene or a styrene derivative may preferably be used singly or in mixture with another monomer from a viewpoint of developability and durability of the toner.

In the production of the polymerization toner of the present invention, a resin may be incorporated in the polymerizable monomer composition upon the polymerization. For example, in order to introduce into a toner a polymerizable monomer component having a hydrophilic functional group such as an amino group, a carboxyl group, a hydroxyl group, a sulfonic acid group, a glycidyl group, and a nitrile group, which cannot be used in an aqueous suspension because of its water-solubility, in the monomer form, resulting in an emulsion polymerization, such a polymerizable monomer component may be incorporated in the toner in the form of a copolymer (a random copolymer, a block copolymer, or a graft copolymer) of the polymerizable monomer component with another vinyl compound such as styrene or ethylene; in the form of a polycondensate such as polyester or polyamide; or in the form of a polyaddition-type polymer such as polyether or polyimine. If a polymer having such a polar functional group coexists in the toner, a phase separation of the wax component is promoted to enhance the encapsulation of the wax, thus providing a toner with better anti-blocking property and developability.

Among above resins, a polyester resin, particularly, contained in the polymerizable monomer exerts a substantial effect. The reasons for the above are considered as follows. The polyester resin contains a large number of ester bonds, each of which is a functional group with a relatively high polarity, so the polarity of the resin itself becomes high. Because of the polarity, polyester tends to distribute inclining toward a surface of a droplet in an aqueous dispersant, and the polymerization proceeds maintaining that state, resulting in a toner. Therefore, the inclining distribution of the polyester resin toward a toner surface promotes a surface state and a surface composition to become uniform. As a result, from a synergistic effect of the chargeability becoming uniform in addition to the enhanced encapsulation of the wax, an exceptionally high developability can be obtained.

As a polyester resin used in the present invention, a saturated polyester resin, an unsaturated polyester resin, or both can be selected accordingly and used to control physical properties such as chargeability, durability, and fixability of the toner.

The polyester resin used in the present invention may be general one constituted of an alcohol component and an acid component. Both components are exemplified below.

Examples of an alcohol component include: ethylene glycol, propylene glycol, 1,3-butanediol, 1,4-butandiol, 2,3-butandiol, diethylene glycol, triethylene glycol, 1,5-pentadiol, 1,6-hexanediol, neopentyl glycol, 2-ethyl-1,3-hexandiol, cyclohexane dimethanol, butenediol, octenediol, cyclohexene dimethanol, bisphenol A hydride, a bisphenol derivative represented by the following formula (I):

(I)

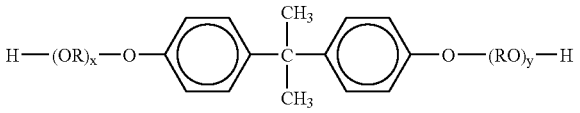

[wherein, R represents an ethylene group or propylene group, x and y are each an integer of 1 or more, and a mean of x+y is 2 to 10], a hydrogenated product of the compound represented by the formula (I), a diol represented by the following formula (II):

(II)

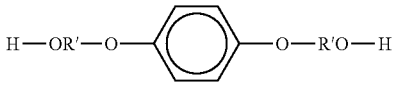

[wherein, R' is $—CH_2CH_2—$ or $—CH_2—CH(CH_3)—$ or or $—CH_2—C(CH_3)_2—$.]

and a diol of the hydrogenated product of the compound represented by the formula (II).

Examples of a divalent carboxylic acid may include: benzenedicarboxylic acids such as phthalic acid, terephthalic acid, isophthalic acid, and phthalic anhydride and anhydrides thereof; alkyldicarboxylic acids such as succinic acid, adipic acid, sebacic acid, and azelaic acid and anhydrides thereof; succinic acid substituted with alkyl groups or alkenyl groups having 6 to 18 carbons and anhydrides thereof; and unsaturated dicarboxylic acids such as fumaric acid, maleic acid, citraconic acid, and itaconic acid and anhydrides thereof.

Examples of an alcohol component may further include: polyhydric alcohols such as glycerin, pentaerythritol, sorbitol, sorbitan, and oxyalkylene ether of a novolak type phenol resin. Examples of an acid component may further include: polyvalent carboxylic acids such as trimellitic acid, pyromellitic acid, 1,2,3,4-butanetetracarboxylic acid, and benzophenonetetracarboxylic acid and anhydrides thereof.

Among the above polyester resins, an alkylene oxide adduct of bisphenol A described above which can provide the toner with excellent chargeability and environmental stability and which can make the toner to have well-balanced other electrophotographic properties may be preferably used. When using the compound, a preferable average addition of alkylene oxide to the compound is 2 to 10 moles in terms of fixability and durability of the toner.

The polyester resin according to the present invention preferably contains, with respect to the total of the components, 45 to 55 mol % of the alcohol component and 55 to 45 mol % of the acid component. In the present invention, the polyester resin has an acid value in a range of preferably 0.1 to 50 mgKOH/(g resin) in order to make the polyester resin exist on the surface of toner particles and the obtained toner particles express stable chargeability. If the acid value is below 0.1 mgKOH/(g resin), the existing amount of the polyester resin on the surface of a toner particle falls absolutely short. If the acid value is above 50 mgKOH/(g resin), chargeability of the toner is impaired. Further, in the present invention, the acid value in a range of 5 to 35 mgKOH/(g resin) is more preferable.

In the present invention, two or more kinds of the polyester resin may be used in combination unless harmful effect is exerted to the physical property of the obtained toner particles. Further, it is preferable to adjust the physical properties of the toner by, for example, modifying the polyester resin by silicone or fluoroalkyl group-containing compound.

Further, when using a polymer containing such a polar functional group, the average molecular weight of the polymer is preferably 5,000 or more. A polymer with an average molecular weight of below 5,000, particularly below 4,000, is not preferable because such a polymer is liable to concentrate near the surface of the toner particle, easily causing harmful effects on developability, anti-blocking property, or the like.

Further, a resin besides those mentioned above may be further incorporated into the monomer composition for the purpose of improving the dispersibility of a material, fixability of a toner, or the image property. Examples of a resin used may include: homopolymers of styrene such as polystyrene and polyvinyl toluene and substituted products thereof; styrene copolymers such as a styrene/propylene copolymer, a styrene/vinyltoluene copolymer, a styrene/vinylnaphthalin copolymer, a styrene/methyl acrylate copolymer, a styrene/ethyl acrylate copolymer, a styrene/butyl acrylate copolymer, a styrene/octyl acrylate copolymer, a styrene/dimethylaminoethyl acrylate copolymer, a styrene/methyl methacrylate copolymer, a styrene/ethyl methacrylate copolymer, a styrene/butyl methacrylate copolymer, a styrene/dimethylaminoethyl methacrylate copolymer, a styrene/vinyl methyl ether copolymer, a styrene/vinyl ethyl ether copolymer, a styrene/vinyl methyl ketone copolymer, a styrene/butadiene copolymer, a styrene/isoprene copolymer, a styrene/maleic acid copolymer, and a styrene/maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic resins, rosins, modified rosins, terpene resins, phenol resins, aliphatic or alicyclic hydrocarbon resins, and aromatic petroleum resins. These resins may be used singly or in combination. Such a resin may preferably be added in 1 to 20 parts by mass with respect to 100 by parts of the polymerizable monomer; below 1 part by mass, the addition effect is scarce, and above 20 parts by mass, designing of various physical properties of the resultant polymerization toner becomes difficult.

Further, if a polymer having a molecular weight different from that of the toner obtained by polymerizing the polymerizable monomer is dissolved in the monomer for polymerization, it is possible to obtain a toner having a broad molecular weight distribution and showing a high anti-offset property.

As a polymerization initiator used in the present invention, conventionally known azo polymerization initiators, peroxide polymerization initiators, or the like may be used in combination with the redox initiator described above. Examples of an azo polymerization initiator include: 2,2'-azobis-(2,4-dimethylvaleronitrile), 2,2'-azobisisobutyronitrile, 1,1'-azobis(cylohexane-1-carbonitrile), 2,2'-azobis-4-methoxy-2,4-dimethylvaleronitrile, and azobisisobutyronitrile. Examples of a peroxide polymerization initiator include: peroxy esters such as t-butyl peroxyacetate, t-butyl peroxylaurate, t-butyl peroxypivalate, t-butyl peroxy-2-ethylhexanoate, t-butyl peroxyisobutyrate, t-butyl peroxyneodecanoate, t-hexyl peroxyacetate, t-hexyl peroxylaurate, t-hexyl peroxypivalate, t-hexyl peroxy-2-ethylhexanoate, t-hexyl peroxyisobutyrate, t-hexyl peroxyneodecanoate, t-butyl peroxybenzoate, α, α'-bis (neodecanoylperoxy) diisopropylbenzene, cumylperoxyneodecanoate, 1,1,3,3-tetramethylbutylperoxy-2-ethylhexanoate, 1,1,3,3-tetramethylbutylperoxyneodecanoate, 1-cyclohexyl-1-methylethylperoxyneodecanoate, 2,5-dimethyl-2,5-bis(2-ethylhexanoylperoxy)hexane, 1-cyclohexyl-1-methylethylperoxy-2-ethylhexanoate, t-hexyl peroxyisopropyl monocarbonate, t-butyl peroxy-2-ethylhexyl monocarbonate, t-hexyl peroxybenzoate, 2,5-dimethyl-2,5-bis(benzoylperoxy)hexane, t-butyl peroxy-m-toluoyl benzoate, bis(t-butylperoxy)isophthalate, t-butylperoxymaleic acid, t-butylperoxy-3,5,5-trimethylhexanoate, and 2,5-dimethyl-2,5-bis (m-toluoylperoxy) hexane; diacyl peroxides such as benzoyl peroxide, lauroyl peroxide, and isobutyryl peroxide; peroxydicarbonates such as diisopropyl peroxydicarbonate and bis (4-t-butylcyclohexyl) peroxydicarbonate; peroxy ketals such as 1,1-di-t-butylperoxycyclohexane, 1,1-di-t-hexylperoxycyclohexane, 1,1-di-t-butylperoxy-3,3,5-trimethylcyclohexane, and 2,2-di-t-butylperoxybutane; dialkylperoxides such dicumylperoxide and t-butylcumylperoxide; and others such as t-butylperoxyaryl monocarbonate.

As a crosslinking agent used in the present invention, a compound having two or more polymerizable double bonds is mainly used. Examples of a crosslinking agent include: aromatic divinyl compounds such as divinylbenzene and divinylnaphthalene; carboxylates having two double bonds such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl groups. These compounds may be used individually or in combination. The addition amount of the crosslinking agent requires adjustment depending on kinds of a polymerization initiator and a kind of the crosslinking agent used for polymerization, and reaction conditions, but basically, 0.01 to 5 parts by mass thereof is suitable with respect to 100 parts by mass of a polymerizable monomer.

As for a colorants used in the present invention, carbon black, magnetic substance, and a colorant toned to a black color using a yellow, magenta, and cyan colorants as described below may be used as a black colorant. Further, as colorants used in a toner obtained by a polymerization, attention must be paid to polymerization inhibitory action or migration property to aqueous-phase inherent in the colorants. A colorant should be preferably subjected to a surface modification (for example, hydrophobic treatment without polymerization inhibition). In particular, much of dyes and carbon black have the polymerization inhibitory action, and hence care must be taken when used. A redox initiator used in the present invention is easily influenced by the polymerization inhibition with carbon black.

Examples of a yellow colorant used may include compounds represented by condensation azo compounds, isoindolinone compounds, anthraquinone compounds, azo metal complexes, methine compounds, and allylamide compounds. Specifically, C.I. Pigment Yellow 12, 13, 14, 15, 17, 62, 74, 83, 93, 94, 95, 109, 110, 111, 128, 129, 147, 168, 180, or the like may be preferably used.

Examples of a magenta colorant used may include condensation azo compounds, diketo-pyrrolo-pyrrole compounds, anthraquinone compounds, quinacridone compounds, basic dye lake compounds, naphthol compounds, benzimidazolone compounds, thioindigo compounds, and perylene compounds. Specifically, C.I. Pigment Red 2, 3, 5, 6, 7, 23, 48:2, 48:3, 48:4, 57:1, 81:1, 122, 146, 166, 169, 177, 184, 185, 202, 206, 220, 221 and 254 are particularly preferable.

Examples of a cyan colorant used in the present invention include copper phthalocyanine compounds and derivatives thereof, anthraquinone compounds, and basic dye lake compounds. Specifically, C.I. Pigment Blue 1, 7, 15, 15:1, 15:2, 15:3, 15:4, 60, 62, 66, or the like may particularly preferably be used.

Any of these colorants may be used alone, in the form of a mixture, or in the state of a solid solution. The colorants of the present invention are selected taking account of hue angle, chroma, brightness, weatherability, transparency on OHP films, and dispersibility in toner particles. The colorant may preferably be used by adding an amount of 1 to 20 parts by mass with respect to 100 parts by mass of the binder resin.

Further, the toner of the present invention may be used as a magnetic toner by incorporating a magnetic substance as a colorant. In this case, the magnetic substance may also serve as the colorant. The magnetic substance incorporated in the magnetic toner may include: iron oxides such as magnetite, hematite, and ferrite; metals such as iron, cobalt, and nickel; alloys of any of these metals with a metal such as aluminum, cobalt, copper, lead, magnesium, tin, zinc, antimony, beryllium, bismuth, cadmium, calcium, manganese, selenium, titanium, tungsten, and vanadium; and mixtures of any of these.

The magnetic substance used in the present invention may preferably be a surface-modified magnetic substance, and may more preferably be those having been subjected to hydrophobic treatment with a surface modifier which is a substance having no polymerization inhibitory action. Such a surface modifier may include, for example, silane coupling agents and titanium coupling agents.

These magnetic substances may preferably be those having an average particle diameter of 2 μm or smaller, and preferably of about 0.1 to 0.5 μm. As an amount of the magnetic substances to incorporate in the toner particles, an amount of 20 to 200 parts by mass, and particularly preferably of 40 to 150 parts by mass, with respect to 100 parts by mass of the binder resin is preferable.

The magnetic substance may preferably be one having a coercive force (Hc) of 1.59 to 23.9 kA/m, a saturation magnetization (σs) of 50 to 200 $Am^2/kg$, and a residual magnetization (σr) of 2 to 20 $Am^2/kg$, as its magnetic characteristics under an application of $7.96\times10^2$ kA/m.

The toner of the present invention may contain a charge control agent for stabilizing a charge property. Charge control agents publicly known can be used, and a charge control agent with a quick charging speed that stably maintains a constant charge is particularly preferable. Further, when producing the toner by a direct polymerization, it is particularly preferred to use a charge control agent showing low polymerization inhibitory action and having substantially no soluble content in an aqueous dispersion medium. Specific examples of a charge control agent as a negative charge control agent may include: metal compounds of aromatic carboxylic acids such as salicylic acids, alkyl salicylic acids, dialkyl salicylic acids, naphthoic acids, and dicarboxylic acids; metal salts or metal complexes of azo dyes or azo pigments; high molecular weight compounds having a sulfonic group or a carboxylic group on a side chain, boron compounds, urea compounds, silicon compounds, and calixarene. Examples of a positive charge control agent may include quaternary ammonium salts, high molecular weight compounds having thereon a side chain, guanidine compounds, nigrosine compounds, and imidazole compounds.

Methods of incorporating the charge control agent in the toner include a method of internally adding the charge control agent to a toner particle and a method of externally adding the charge control agent to the toner particle. A usage amount of the charge control agent is determined by the production method of the toner including a kind of a binder resin, presence of other additives, and a dispersion method; therefore, is not limited by any one. However, in an internal addition method, the charge control agent may preferably be used in a range of 0.1 to 10 parts by mass, more preferably 0.1 to 5 parts by mass, with respect to 100 parts by mass of the binder resin. In an external addition method, the charge control agent may preferably be used in a range of 0.005 to 1.0 parts by mass, more preferably 0.01 to 0.3 parts by mass, with respect to 100 parts by mass of the binder resin.

In a method for producing the toner of the present invention by the polymerization process, toner ingredients such as a colorant, a magnetic powder, a wax or the like may be desirably added to a polymerizable monomer. The thus-obtained polymerizable monomer mixture is further subjected to uniform dissolution or dispersion by a disperser such as a homogenizer, a ball mill, a colloid mill, or an ultrasonic disperser to produce a polymerizable monomer composition. Then, the polymerizable monomer composition is suspended in an aqueous medium containing a dispersion stabilizer. In this instance, if the suspension system is subjected to a dispersion into a desired toner size at a stretch using a high-speed dispersing machine, such as a high-speed agitator or the ultrasonic disperser, the particle diameter distribution of the resultant toner particles becomes sharper. An organic peroxide as a redox initiator and other polymerization initiator may be added to the polymerizable monomer together with other additives as described above or just before suspending the polymerizable monomer composition into the aqueous medium. In addition, the polymerization initiator dissolved in a polymerizable monomer or a solvent can be added prior to the polymerization reaction during granulation or just after granulation. A reducing agent as a redox initiator may be added to the aqueous medium in advance,. during granulation, or during the polymerization reaction just after granulation.

After granulation, the system is agitated by an ordinary agitator to retain a dispersed particle state and to prevent the floating or sedimentation of the particles.

When producing the toner of the present invention by the polymerization process, a known surfactant, or an organic or inorganic dispersant, may be used as a dispersion stabilizer. Among those, the inorganic dispersant may preferably be used for the following reasons: the inorganic dispersant is less liable to result in harmful ultrafine particle; the resultant dispersion stability is less liable to be destabilized even in a reaction temperature change because the dispersion stabilization effect is attained by a steric hindrance of the inorganic dispersant; and the inorganic dispersant is easily washed and is less liable to leave an adverse effect on the toner. Examples of an inorganic dispersant may include: polyvalent metal phosphates such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina.

Such an inorganic dispersant as described above may be used in a commercially available state as it is, but in order to obtain finer particles thereof, inorganic dispersant particles may be produced in an aqueous medium. For example, in a case of calcium phosphate, a sodium phosphate aqueous solution and a calcium chloride aqueous solution may be blended under high-speed agitating to form water-insoluble calcium phosphate allowing more uniform and finer dispersion state. At this time, water-soluble sodium chloride is by-produced, but the presence of a water-soluble salt in an aqueous medium suppresses a dissolution of a polymerizable monomer into the water, thus suppressing the production of ultrafine toner particles caused by an emulsion polymerization, and thus being more convenient. The inorganic dispersant can be removed substantially completely by dissolving with an acid or an alkaline after the completion of the polymerization.

These inorganic dispersants may be desirably used independently in 0.2 to 20 parts by mass with respect to 100 parts by mass of the polymerizable monomer. When the inorganic dispersants are used, although ultrafine particles are less liable to be produced, atomization of toner particles is rather difficult; therefore, it is also possible to use 0.001 to 0.1 part by mass of a surfactant in combination.

Examples of a surfactant may include sodium dodecylbenzene sulfate, sodium tetradecyl sulfate, sodium pentadecyl sulfate, sodium octyl sulfate, sodium oleate, sodium laurate, sodium stearate, and potassium stearate.

In the polymerization step, a polymerization temperature may be set to 40° C. or above, generally in a range of 50 to 90° C. By conducting polymerization in this temperature range, the wax or wax type component to be encapsulated inside the toner particles may deposit by phase separation to allow a more complete encapsulation. In order to consume the remaining polymerizable monomer, the reaction temperature may possibly be raised to 90 to 150° C. in the final stage of polymerization. Also, in the present invention, it is preferable that distillation is conducted to adjust the amount of t-butanol in the toner.

After polymerization, the polymerization toner particles may be filtered, washed, and dried according to the known methods and be blended with an inorganic fine particle for adhesion onto the toner particle surface if required, to obtain the toner according to the present invention. It is also a desirable mode of the present invention to add a classification step in the production step to remove coarse powders and fine particles.

It is also a preferable mode that inorganic fine particle having a number-average primary particle diameter of 4 to 100 nm is added as a flowability-improving agent. The inorganic fine particle is added mainly for the purpose of improving the toner flowability and charge uniformization of the toner particles but treatments of the inorganic fine particle such as hydrophobic treatment may enable adjustment of charge amount of the toner, improvement of environmental stability, or the like.

In a case where the inorganic fine particle has a number-average primary particle diameter larger than 100 nm, or the inorganic fine particle of 100 nm or smaller is not added, satisfactory toner flowability cannot be obtained. The toner particles are liable to be ununiformly charged to result in problems such as increased fogging, decrease of image density, and toner scattering. In a case where the inorganic fine particle has a number-average primary particle diameter smaller than 4 nm, agglomeratability of the inorganic fine particle increases. The inorganic fine particle is liable to behave as an agglomerate, rather than the primary particles, of a broad particle diameter distribution having strong agglomeratability such that the disintegration of the agglomerate is difficult even with crushing means. Therefore, it is liable to result in image defects such as a development with the agglomerates and defects attributed to damages on an image-bearing member, a toner-bearing member, or the like. In order to provide a more uniform charge distribution to the toner particles, it is further preferred that the number-average primary particle diameter of the inorganic fine particle is in a range of 6 to 70 nm.

The measurement of the number-average primary particle diameter of the inorganic fine particle of the present invention is performed as follows. An enlarged picture of the toner photographed by a scanning electron microscope is compared with a picture of the toner mapped with elements contained in the inorganic fine particle obtained by an elementary analyzer such as an XMA equipped to the scanning electron microscope. Then, 100 or more of the primary particles of inorganic fine particle attached onto or liberated from the toner particles are measured to provide a number-based average primary particle.

An inorganic fine particle used in the present invention may preferably include silica, titanium oxide, alumina, or the like, and may be used independently or in combination of multiple kinds. As silica, for example, both dry process silica (in some cases, called fumed silica) formed by a vapor phase oxidation of silicon halide and wet process silica formed from water glass or the like may be used. However, dry process silica is preferable because of fewer silanol groups on the surface and inside a silica fine particle and also less production residues such as $Na_2O$ and $SO_3^{2-}$. A complex fine particle of silica and other metal oxides, for example, by using another metal halide such as aluminum chloride or titanium chloride together with silicon halide in the production process can be obtained and may be included as the dry process silica.

It is preferable that the inorganic fine particle having a number-average primary particle diameter of 4 to 100 nm is added in an amount of 0.1 to 3.0% by mass with respect to the toner particles. With the addition amount below 0.1% by mass, the effect is insufficient, and with the one of 3.0% or more by mass, the fixability deteriorates.

The inorganic fine particle content may be determined using a fluorescent X-ray analysis while referring to a calibration curve prepared using standard samples.

Further, the inorganic fine particle used in the present invention may preferably had been hydrophobic treated. The hydrophobic treated fine particles are preferable in properties under high temperature and high humidity environment. If the inorganic fine particle added to the toner absorbs moisture, the chargeability of the toner particles remarkably declines, and toner scattering becomes liable to occur.

A hydrophobic treatment agent used for the inorganic fine particle may include a silicone varnish, various modified silicone varnishes, a silicone oil, various modified silicone oils, silane compounds, silane coupling agents, other organic silicon compounds, and organic titanate compounds, and these may be used singly or in combination. Among those, an inorganic fine particle treated with the silicone oil is preferable. The inorganic fine particle treated with the silicone oil simultaneously with or after hydrophobic treatment with a silane compound is more preferable for retaining the high charge amount of the toner particles at a high level and preventing the toner scattering.

Such a treating method for the inorganic fine particle includes, for example, conducting a silylation with a silane compound to remove a silanol group by a chemical bonding as a first reaction, and forming a hydrophobic thin film on the surface of the inorganic fine particle with silicone oil as a second reaction.

The silicone oil may preferably have a viscosity of 10 to 200,000 $mm^2/s$, more preferably 3,000 to 80,000 $mm^2/s$ at 25° C. If the viscosity is below 10 $mm^2/s$, the inorganic fine particle lacks stability, and the image quality tends to become inferior with heat or mechanical stress. On the other hand, if the viscosity is above 200,000 $mm^2/s$, uniform treatment tends to become difficult.

As a silicone oil particularly preferably used, for example, dimethyl silicone oil, methyl phenyl silicone oil, α-methyl-styrene-modified silicone oil, chlorophenyl silicone oil, fluorine-modified silicone oil, and the like are particularly preferable.

A method of treating the inorganic fine particle with a silicone oil includes a direct blending method of the inorganic fine particle treated with a silane compound with silicone oil by means of a blender such as a Henschel mixer or a spraying method of silicone oil onto the inorganic fine particle. Alternatively, the treatment may be performed by dissolving or dispersing silicone oil in an appropriate solvent and adding thereto the inorganic fine particle for blending to remove the solvent. Because of less production of the agglomerates of the inorganic fine particle, the method using a spray is more preferable.

The silicone oil for the treatment may be used in an amount of 1 to 40 parts by mass, preferably 3 to 35 parts by mass with respect to 100 parts by mass of the inorganic fine particle. If the amount of the silicone oil is too small, satisfactory hydrophobicity cannot be attained, and if the amount is too large, disadvantages in an image such as fogging tend to occur.

The inorganic fine particle used in the present invention is preferably silica, alumina, or titanium oxide to provide the toner with a satisfactory flowability, and among those, silica is particularly preferable. Further, silica preferably has a specific surface area measured with a BET method by nitrogen adsorption in a range of 20 to 350 $m^2/g$, and more preferably, 25 to 300 $m^2/g$.

The BET specific surface area of inorganic fine particle is calculated using a BET multipoint method with a specific surface area measurement device (Autosorp 1, manufactured by Yuasa Ionics Inc.), adsorbing nitrogen gas onto a sample surface.

In the present invention, a rate of liberation of the inorganic fine particle in the toner is preferably 0.1 to 2.0%, and more preferably 0.1 to 1.50%. The rate of liberation of inorganic fine particles liberated from toner particles described herein is measured using a particle analyzer ("PT1000", manufactured by Yokogawa Denki K.K.) according to a principle described in "Japan Hardcopy '97 Paper Collection", pp. 65–68. More specifically, in the apparatus, fine particles such as the toner particles are introduced into plasma, particle by particle, to determine an element, a number, and a size of the particles from their emission spectra. For example, when using silica as an inorganic fine particle, the rate of liberation is determined according to the following formula based on the simultaneity of emission of carbon atom constituting the binder resin and emission of silicon atom.

Liberation percentage of silica (%)=100×(number of emissions of silicon atom alone)/{(number of emissions of silicon atom simultaneous with emission of carbon atom)+(number of emissions of silicon atom alone)}

Here, the emission of silicon atom within 2.6 msec from the emission of carbon atom is regarded as simultaneous emission of carbon atom and silicon atom, and the emission of silicon atom thereafter is regarded as the emission of silicon atom alone.

A more specific measurement method is as follows. A sample toner left standing overnight and conditioned in an environment of 23° C. and 60% RH is measured using 0.1% oxygen-containing helium gas in the same environment. The emissions of carbon atom and the silicon atom are measured with a Channel 1 detector and a Channel 2 detector, respectively (with a measurement wavelength of 288.160 nm and a recommended value of K factors). Sampling is performed such that one scan allows the 1,000 to 1,400 carbon atom emissions, and the scanning is repeated until the number of carbon atom emissions reaches at least 10,000 in total to integrate the number of emissions. In this case, the measurement is performed so that a distribution drawn with the number of carbon atom emissions as the ordinate and with the cubic root of voltage of carbon atom as the abscissa exhibits a single peak and no valley through the sampling. Based on the above data, a noise cut level of the total elements is set at 1.50 volts, and the rate of liberation (%) of the silica is calculated using the above formula. Examples described later are measured in the same manner.

By comprehensive studies of the inventors of the present invention, with a rate of liberation below 0.1%, an increase of fogging and roughness occurs on an image in the latter half of multiple-page print out test, particularly under high temperature and high humidity environment. Generally, embedding of external additives into the toner particles easily occurs from stress caused by a regulating member or the like in a high temperature environment, flowability of the toner after printing multiple pages becomes inferior to that at the beginning, and it is considered that the above problems may occur. However, if a rate of liberation of the silica is 0.1% or more, such problems are less liable to occur. The inventors of the present invention have considered that when silica exists in a rather liberated state, the flowability of the toner becomes favorable. Therefore, the embedding of the silica into the toner particle under endurable use is prevented, and the reduction of toner flowability lessens by attaching the liberated silica onto the toner surface even if the embedding of silica adhered to the toner occurs from stress.

On the contrary, the rate of liberation of silica above 2.00% is not preferable because the liberated silica contaminates a charge control member and an increase of fog develops. Further, in such a state, the charge uniformity of the toner is impaired, and transfer efficiency is lowered. It is important that the liberation percentage of silica is 0.1 to 2.0%.

It is also a preferable mode of the present invention to further add inorganic or organic fine particles having a shape close to a sphere and a primary particle diameter exceeding 30 nm (preferably, specific surface area of below 50 $m^2/g$), more preferably a primary particle diameter exceeding 50 nm (preferably, specific surface area of below 30 $m^2/g$) for the purpose of enhancing the cleaning property or the like. Preferable examples of the fine particles may include spherical silica particles, spherical polymethyl silsesquioxane particles, and spherical resin particles.

Within an extent of not having a substantially adverse effect on the magnetic toner used in the present invention, it is also possible to further include other additives, for example: a lubricant powder such as a polyethylene fluoride powder, a zinc stearate powder, and a polyvinylidene fluoride powder; and abrasives such as a cerium oxide powder, a silicon carbide powder, and a strontium titanate powder. It is also possible to add a small amount of reverse-polarity organic and inorganic fine particle as a developability-improving agent. Such additives may also be added after performing hydrophobic treatment the surface thereof.

For externally adding the above fine particle to the toner particles, a method of blending and agitating the toner particles and the fine powder can be used. As a device used for agitating, specifically, a mechanofusion system, an I-type mill, a hybridizer, a turbo mill, and a Henschel mixer may be used. The use of the Henschel mixer may especially be preferable in view of preventing coarse particles from forming.

Conditions of external addition such as temperature, strength of adding force, and time period may preferably be adjusted in order to adjust the rate of liberation of the fine particles. By way of example, when a Henschel mixer is used, a temperature of tank during external addition may preferably be controlled at 50° C. or less. With this temperature or above, the external additives become abruptly embedded into the toner particles by heat, and coarse particles form undesirably, which is not preferable. A peripheral speed of a blade of the Henschel mixer may preferably be regulated to 10 to 80 m/sec from the viewpoint of adjusting the liberation percentage of the external additive.

The toner of the present invention may be used as a non-magnetic one-component developer or a two-component developer having a carrier particle. A non-magnetic toner may be attached onto a developing sleeve by forced triboelectrification using a blade or a roller and be conveyed in this state.

When using the toner of the present invention as a two-component developer, a magnetic carrier is used with the toner. The magnetic carrier may be constituted from an element such as iron, copper, zinc, nickel, cobalt, manganese, or chromium alone or in a complex ferrite state. The magnetic carrier may take a spherical, flat, or irregular shape. It is preferable to control the fine surface structure (e.g., surface unevenness) of the magnetic carrier particles. Generally, a method used include calcining and granulating the metal or ferrite described above to produce magnetic carrier core particles in advance and then coating the particles with a resin. For the purpose of reducing the load of the magnetic carrier on the toner, it is possible to apply a method of kneading the metal or ferrite and a resin, followed by pulverization and classification to prepare a low-density dispersion-type carrier and a method of directly performing suspension polymerization of a kneaded mixture of the metal or ferrite and a monomer in an aqueous medium to prepare a spherical magnetic carrier.

Coated carriers obtained by coating the above-mentioned carrier particle surface with a resin are particularly preferable. Applicable coating methods include a method of dissolving or suspending a resin in a solvent and then applying the mixture to attach to the carrier particles, and a method of simply blending powdery resin and carrier particles to attach thereto.

Examples of an adherend onto carrier particle surfaces, although depending on the toner material, may include polytetrafluoroethylene, a monochlorotrifluoroethylene polymer, polyvinylidene fluoride, a silicone resin, a polyester resin, a styrene resin, an acrylic resin, polyamide, polyvinyl butyral, and amino-acrylate resin. Those materials may be used singly or in mixture of two or more thereof.

The carrier preferably has the following magnetic properties. It is preferable to use a carrier having a magnetization intensity ($\sigma_{79.6}$) of 3.77 to 37.7 μWb/cm$^3$ measured at 79.57 kA/m (1,000 oersteds) after magnetic saturation. More preferably, the carrier has a magnetization intensity of 12.6 to 31.4 μWb/cm$^3$ to attain a higher image quality. If the carrier has a magnetization intensity of more than 37.7 μWb/cm$^3$, a high quality toner image may be obtained with difficulty. If it has a magnetization intensity of less than 3.77 μWb/cm$^3$, a magnetic binding force may decrease, easily causing carrier adhesion.

In a case of preparing a two-component developer by blending the toner of the present invention and the magnetic carrier, a favorable result can be obtained generally by adjusting the blending ratio so that a concentration of the toner in a developer becomes 2 to 15% by mass, preferably 4 to 13% by mass.

Hereinafter, referring to the accompanying drawings, a description will be given of an image forming method to which the toner of the present invention is applicable.

Figure 3:
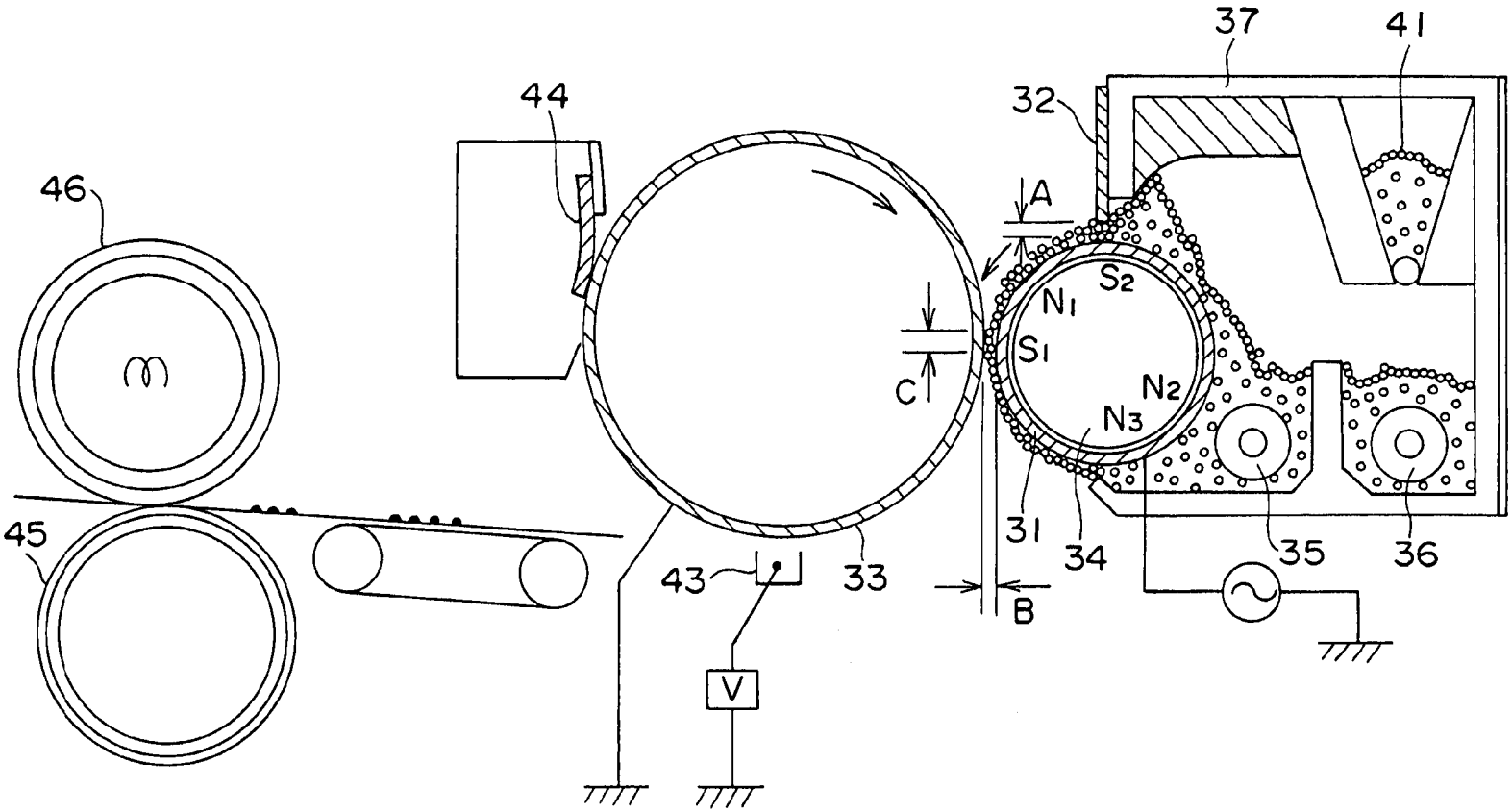
FIG. 3 is a schematic diagram of a developing device to which a toner of the present invention may be applied.

The toner of the present invention may be mixed with magnetic carries for development with a developing unit 37 as shown in FIG. 3, for example. To be specific, preferably, a developer bearing member is applied with an alternating electric field while the development is performed in a state where a magnetic brush comes into contact with an electrostatic image bearing member (e.g., photosensitive drum) 33. A distance (S-D interspace) B between a developer bearing member (developing sleeve) 31 and the photosensitive drum 33 is preferably 100 to 1,000 μm in that the carriers are prevented from adhering onto the photosensitive drum 33 and the dot reproducibility increases. If the distance is below 100 μm, the developer is likely to be in short supply, leading to the low image density. In contrast, if the distance exceeds 1,000 μm, lines of magnetic force from a magnetic pole $S_1$ expands to lower a magnetic brush density, resulting in the poor dot reproducibility or easily causing the carriers to adhere on the photosensitive drum due to the weakened force of binding the carriers on the developer bearing member 31. A toner 41 is supplied in succession to a developing device and mixed with the carries by agitating units 35 and 36, and transported up to the developing sleeve 31 that includes a stationary magnet 34.

A peak-to-peak voltage of the alternating electric field is preferably 500 to 5,000 V and a frequency thereof is preferably 500 to 10,000 Hz, more preferably 500 to 3,000 Hz. Those values may be appropriately selected according to the process. In this case, a waveform may be selected in use among various waveforms including a triangular wave, a rectangular wave, a sine wave, and other waveforms with different duty ratios. An applied voltage is lower than 500 V, the sufficient image density is hard to obtain; the fogging toner in a non-image area cannot be well collected in some cases. In contrast, with the voltage above 5,000 V, the electrostatic image is disturbed through the magnetic brush, which may cause the image quality deterioration.

By using the two-component developer containing the well charged toner, a fogging elimination voltage (Vback) can be lowered. In addition, a potential of the charged photosensitive member upon primary charge can be lowered, thereby prolonging the service life of the photosensitive member. The voltage Vback is, although depending on the developing system, preferably 150 V or smaller, more preferably 100 V or smaller.

A contrast potential of 200 V to 500 V is preferably adopted for achieving a sufficient image density.

The frequency of the alternating electric field is below 500 Hz, which induces the charge injection to the carriers, although depending on a process speed, thereby causing the carrier adhesion or the disturbed latent image to deteriorate the image quality in some cases. The frequency above 10,000 Hz makes it impossible for the toner to follow up the electric field, easily causing the image quality deterioration.

In order to perform the development while achieving the sufficient image density and the high dot reproducibility without causing the carrier adhesion, a contact width (developing nip C) between the magnetic brush on the developing sleeve 31 and the photosensitive drum 33 is preferably adjusted to 3 to 8 mm. If the developing nip C is below 3 mm, it is difficult to meet the sufficient image density and the high dot reproducibility in a favorable condition. In contrast, if the developing nip C is above 8 mm, the developer may be packed in the nip to suspend the operation of the apparatus, or the carrier is hardly kept from adhering thereto. As a method of adjusting the developing nip C, a distance A between a developer-regulating member 32 and the developing sleeve 3 or the distance B between the developing sleeve 31 and the photosensitive drum 33 is adjusted.

In particular, upon outputting a full-color image, in which halftones are regarded as important, three or more developing devices including the devices for colors of magenta, cyan, and yellow are used, and the developer containing the toner of the present invention and the developing method are preferably adopted, in particular, in combination with the developing system in which a digital latent image is formed. As a result, the latent image can be completely developed according to the dot latent image because the magnetic brush gives no influence thereon and causes no disturbance of the latent image, which is preferable. Also in a transfer step, the toner of the present invention is preferably used to thereby attain the high transfer efficiency, with the result that the high-quality image can be formed both in a halftone area and in a solid image area.

Further, in addition to the achievements of the high-quality image formation at the initial stage, use of the toner according to the present invention yields the effects of the present invention fully in which the image is free of the quality deterioration when copying a number of sheets.

The toner image held on the electrostatic image bearing member 33 is transferred onto a transferring material by a transfer unit 43 such as a corona charger. The toner image on the transferring material is fixed by a heat-pressure fixing unit including a heating roller 46 and a pressure roller 45. The transfer residual toner on the electrostatic image bearing member 33 is removed from the electrostatic image bearing member 33 with a cleaning unit 44 such as a cleaning blade. The toner of the present invention excels in transfer efficiency in the transfer step and involves less transfer residual toner as well as excels in cleaning property. Thus, filming is hard to occur on the electrostatic image bearing member. Further, even in a multi-sheet running durable test, the toner of the present invention suppresses embedding the external additives into the toner particle surface more than the conventional toner does, thereby making it possible to keep the favorable image quality over a long period.

In order to obtain the favorable full-color image, the developing devices for magenta, cyan, yellow, and black are provided and the black toner image is developed last of all, so that a sharp image can be obtained.

Figure 4:
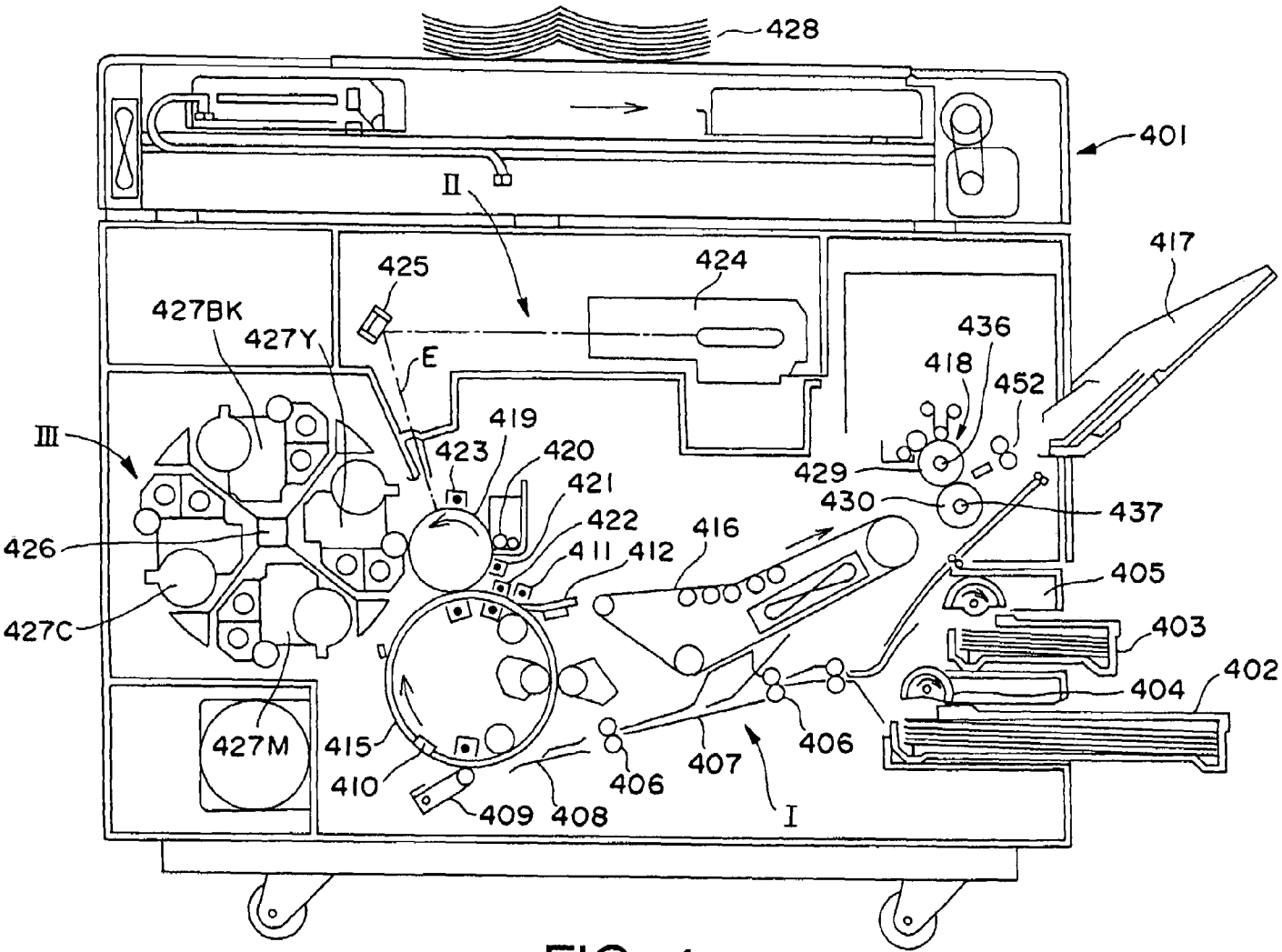
FIG. 4 is a schematic diagram illustrating an image forming apparatus employing a full-color or a multi-color image forming method.

Referring to FIG. 4, a description will be given of an example of an image forming apparatus capable of carrying out a multi- or full-color image forming method in a satisfactory manner.

A color electrophotographic apparatus shown in FIG. 4 is roughly separated into a transferring material transport system I so provided as to extend from a right side of the apparatus main body to a substantially central portion thereof; a latent image forming part II provided in the substantially central portion of the apparatus main body close to a transfer drum 415 constituting the transferring material transport system I; and a developing unit (i.e., a rotational developing device) III provided close to the latent image forming part II.

The transferring material transport system I is structured as follows. An opening is formed in a right wall (right side in FIG. 4) of the apparatus main body and transferring material feeding trays 402 and 403 detachably attachable to the apparatus through the opening are disposed while partially protruding toward the outside of the apparatus. Sheet feed rollers 404 and 405 are disposed substantially directly above the trays 402 and 403, respectively. A sheet feed roller 406, and sheet feed guides 407 and 408 are provided so as to connect between the sheet feed rollers 404 and 405 and the transfer drum 415 provided on the left side rotatably in the direction of arrow A. An abutment roller 409, a gripper 410, a transferring material separation charger 411, and a separation claw 412 are arranged on the periphery of an outer peripheral surface of the transfer drum 415, in the stated order from the upstream side in the rotational direction to the downstream side thereof.

On an inner peripheral surface of the transfer drum 415, a transfer charger 413 and a transferring material separation charger 414 are disposed. A transfer sheet (not shown) formed of a polymer such as polyvinylidene fluoride is bonded on the surface of the transfer drum 415 on which the transferring material winds around the drum. The transferring material is electrostatically attached onto the transfer sheet in close contact therewith. A conveyor belt unit 416 is disposed on the upper right side of the transfer drum 415 closer to the separation claw 412. A fixing device 418 is arranged at a terminal in the transferring material transport direction (right side) of the conveyor belt unit 416. On the more downstream side in the transport direction as viewed from the fixing device 418, a delivery tray 417 detachably attachable to an apparatus main body 401 is disposed extending toward the outside of the apparatus main body 401.

Next, a structure of the latent image forming part II will be described. A photosensitive drum (e.g., OPC photosensitive drum) 419 as a latent image bearing member is arranged rotatably in the direction of the arrow shown in FIG. 4 in such a way that its outer peripheral surface comes into contact with the outer peripheral surface of the transfer drum 415. A discharger 420, a cleaning unit 421, and a primary charger 423 are arranged on the upper side of the photosensitive drum 419 and on the periphery of the outer peripheral surface thereof, in the stated order from the upstream side in the rotational direction of the photosensitive drum 419 to the downstream side thereof. In addition, an image exposure unit 424 such as a laser beam scanner and an image exposure light reflecting unit 425 such as a mirror are disposed, which are adapted to form an electrostatic latent image on the outer peripheral surface of the photosensitive drum 419.

The rotational developing device III is structured as follows. A rotatable case (hereinafter, referred to as "rotary member") 426 is disposed opposite to the outer peripheral surface of the photosensitive drum 419. Four developing devices are incorporated in the rotary member 426 at four positions in its circumferential direction and serve to visualize (i.e., develop) the electrostatic latent image formed on the outer peripheral surface of the photosensitive drum 419. The four developing devices respectively correspond to a yellow developing device 427Y, a magenta developing device 427M, a cyan developing device 427C, and a black developing device 427BK.

An operation sequence of the entire image forming apparatus thus structured will be described taking the case of a full-color mode as an example. The photosensitive drum 419 is rotated in the direction of the arrow of FIG. 4 and then, charged with the primary charger 423. In the apparatus of FIG. 4, a peripheral speed (hereinafter, referred to as process speed) of the photosensitive drum 419 is set to 100 mm/sec or higher (e.g., 130 to 250 mm/sec). After the primary charger 423 charges the photosensitive drum 419, an image exposure is effected with a laser beam E modulated according to a yellow image signal corresponding to an original image 428. Thus, the electrostatic latent image is formed on the photosensitive drum 419. The yellow developing device 427Y, which has been already in position (developing position) in accordance with the rotation of the rotary member 426, develops the electrostatic latent image to form a yellow toner image.

The transferring material transported through the feed guide 407, the sheet feed roller 406, and the feed guide 408 is gripped with the gripper 410 at a predetermined timing and electrostatically wound around the transfer drum 415 by means of the abutment roller 409 and an electrode opposing the abutment roller 409. The transfer drum 415 rotates in the direction of the arrow in FIG. 4 in synchronization with the rotation of the photosensitive drum 419. The yellow toner image formed by the yellow developing device 427Y is transferred onto the transferring material in a portion where the outer peripheral surfaces of the photosensitive drum 419 and the transfer drum 415 come into contact with each other, by the transfer charger 413. The transfer drum 415 keeps on rotating as is and stands by for transfer of the toner image in next color (magenta color in FIG. 4).

The photosensitive drum 419 is discharged by the discharger 420 and cleaned by the cleaning blade constituting the cleaning unit 421 and then, recharged by the primary charger 423. The image exposure is performed according to the next magenta image signal to form the electrostatic latent image on the surface of the photosensitive drum 419. The rotational developing device rotates while the electrostatic latent image is formed on the photosensitive drum 419 through the image exposure according to the magenta image signal, to arrange the magenta developing device 427M in the predetermined developing position, thereby developing the image with the magenta toner. Following this, the same process as the above is conducted also for cyan and black. After the toner images in four colors are transferred, visualized images in four colors formed on the transferring material are discharged with a charger 422 and the charger 414 to release a grip force of the gripper 410 acting on the transferring material. At the same time, the transferring material is separated from the transfer drum 415 by the separation claw 412 and transported to the fixing device 418 by the conveyor belt 416 to fix the image thereon through the heat and pressure application. Thus, a full-color print sequence is completed to form a desired full-color print image on one side of the transferring material.

Next, referring to FIG. 5, another image forming method will be described in more detail. In an apparatus system shown in FIG. 5, developers containing a cyan toner, a magenta toner, a yellow toner, and a black toner are stored into developing devices 54-1, 54-2, 54-3, and 54-4, respectively. The electrostatic latent image formed on a photosensitive member 51 is developed, for example, by a magnetic brush developing method or non-magnetic one-component developing method. Thus, the toner images in the respective colors are formed on the photosensitive member 51. The photosensitive member 51 constitutes a photosensitive drum or photosensitive belt comprising a photoconductive insulating material layer formed of a-Se, CdS, $ZnO_2$, OPC, a-Si, etc. The photosensitive member 51 is rotated by a driving device (not shown) in the direction of the arrow of FIG. 5.

As the photosensitive member 51, the one having an amorphous silicon photosensitive layer or an organic photosensitive layer is preferably used.

The organic photosensitive layer may be of a single-layer type where a photosensitive layer contains a charge generating material and a material having a charge transporting property in the same layer or may be a separated-function photosensitive layer composed of the charge transporting layer and the charge generating layer. Given as a preferred example thereof is a multi-layer type photosensitive layer so structured that the charge generating layer and the charge transporting layer are laminated in order on a conductive substrate.

A binder resin of the organic photosensitive layer is preferably a polycarbonate resin, a polyester resin, or an acrylic resin when in use. Using such a binder resin, in particular, the transferring property and the cleaning property are satisfactory and hence, any cleaning failure, fusion of toner to the photosensitive member, or filming of the external additives hardly occurs.

The charging step adopts either a non-contact type system using a corona charger or a contact type system using a roller etc., with respect to the photosensitive member 51. To realize a uniform charging operation with a high efficiency, a simplification, and a reduction of ozone generation, as shown in FIG. 5, the contact type system is preferably used.

A charging roller 52 is basically constituted of a central core metal 52*b* and a conductive elastic layer 52*a* formed around the outer peripheral surface of the core metal 52*b*. The charging roller 52 is brought into press contact with the photosensitive member 51 surface with a pressure and rotated in accordance with the rotation of the photosensitive member 51.

Preferred process conditions in the case of using the charging roller are as follows. When a roller contact-pressure is set to 5 to 500 g/cm, in the case of using a DC voltage superposed with an AC voltage, the AC voltage is 0.5 to 5 kVpp, an AC frequency is 50 Hz to 5 kHz, and the DC voltage is ±0.2 to ±1.5 kV; in the case of using the DC voltage, the DC voltage is ±0.2 to ±5 kV.

Another charging method is, for example, a method of using a charging blade or a conductive brush. Those contact charging units yield an effect in that the high voltage is not required and the ozone generation is suppressed.

A material for the charging roller and the conductive blade as the contact charging unit is preferably conductive rubber and its surface may be coated with a coating film having releaseability. A nylon resin, PVDF (poly vinylidene fluoride), PVDC (poly vinylidene chloride), or the like can be used for the coating film.

The toner image formed on the photosensitive member is transferred onto an intermediate transfer member 55 applied with a voltage (e.g., ±0.1 to ±5 kv). The photosensitive member surface after the transfer is cleaned by a cleaning unit 59 having a cleaning blade 58.

The intermediate transfer member 55 is constituted of a pipe-shaped conductive core metal 55*b* and a medium-resistance elastic layer 55*a* formed around an outer peripheral surface of the core metal 55*b*. The core metal 55*b* may be a plastic pipe with conductive plating.

The medium-resistance elastic layer 55*a* is a solid or foamed-material layer consist of an elastic material such as a silicone rubber, a fluorine rubber, a chloroprene rubber, an urethane rubber, or EPDM (ethylene propylene diene three-dimensional copolymer) while adjusting an electric resistance (volume resistivity) to a medium resistance of $10^5$ to $10^{11}$ Ω·m by blending and dispersing a conductivity imparting material such as a carbon black, zinc oxide, tin oxide, or silicon carbide in the elastic material.

The intermediate transfer member 55 is disposed in contact with the lower surface of the photosensitive member 51 while being axially supported in parallel with the photosensitive member 51. Then, the intermediate transfer member rotates counterclockwise as indicated by the arrow of FIG. 5 at the same peripheral speed as in the photosensitive member 51.

The toner image in a first color formed and carried on the photosensitive member 51 surface undergoes intermediate transfer onto the outer surface of the intermediate transfer member 55 successively in the process of passing through a transfer nip portion where the photosensitive member 51 and the intermediate transfer member 55 contact each other, by the electric field generated in the transfer nip portion by a transfer bias applied to the intermediate transfer member 55.

If required, the intermediate transfer member 55 surface is cleaned by a detachably attachable cleaning unit 500 after the toner image is transferred onto the transferring material. In the case where the toner image exists on the intermediate transfer material, the cleaning unit 500 is distanced from the intermediate transfer member surface lest the unit should disturb the toner image.

A transfer unit 57 is disposed in contact with the lower surface of the intermediate transfer member 55 while being axially supported in parallel with the intermediate transfer member 55. The transfer unit 57 is, for example, a transfer roller or a transfer belt and rotates clockwise as indicated by the arrow of FIG. 5 at the same peripheral speed as in the intermediate transfer member 55. The transfer unit 57 may be disposed in direct contact with the intermediate transfer member 55 or in indirect contact therewith through the belt or the like.

The transfer roller is basically constituted of a central core metal 57*b* and a conductive elastic layer 57*a* constituting an outer peripheral portion thereof.

A general material may be used for the intermediate transfer member and the transfer roller. By setting a specific volume resistivity of the elastic layer of the transfer roller much smaller than that of the elastic layer of the intermediate transfer member, the applied voltage to the transfer roller can be lowered. This makes it possible to form the satisfactory toner image on the transferring material as well as to keep the transferring material from winding around the intermediate transfer member. In particular, the specific volume resistivity of the elastic layer of the intermediate transfer member is more preferably 10 times or more as high as that of the elastic layer of the transfer roller.

A hardness of the intermediate transfer member and the transfer roller is measured based on JIS K-6301. The intermediate transfer member used in the present invention is preferably constituted of the elastic layer within a hardness range of 10 to 40 degrees. On the other hand, the hardness of the elastic layer of the transfer roller is preferably higher than that of the elastic layer of the intermediate transfer member, for example, 41 to 80 degrees, from the viewpoint of keeping the transferring material from winding around the intermediate transfer member. If the hardness value of the transfer roller is smaller than that of the intermediate transfer member, a concave portion is formed on the transfer roller, thereby easily causing the transferring material to wind around the intermediate transfer member.

The transfer unit 57 is rotated at an equal or different peripheral speed with respect to the intermediate transfer member 55. A transferring material 56 is transported between the intermediate transfer member 55 and the transfer unit 57 and at the same time, the bias with a polarity reverse to a triboelectric charge of the toner is applied from a transfer bias applying unit to the transfer unit 57, so that the toner image on the intermediate transfer member 55 is transferred onto the surface side of the transferring material 56.

The same material as the charging roller may be used for a transfer member. Preferred transfer process conditions are as follows: the roller contact pressure is 5 to 500 g/cm and the DC voltage is ±0.2 to ±10 kV.

For example, the conductive elastic layer 57*a* of the transfer roller as a transfer member is formed of an elastic material such as polyurethane or ethylene-propylene-diene three-dimensional copolymer (EPDM), in which the conductive material such as carbon is dispersed, with the volume resistivity of about $10^6$ to $10^{10}$ Ω·cm. The core metal 57*b* is applied with a bias from a constant voltage power source. The bias condition is preferably set to ±0.2 to ±10 kV.

Next, the transferring material 56 is transported to a fixing device 501 basically constituted of a heating roller having a built-in heating element such as a halogen heater and a pressure roller consist of an elastic material, which is brought into press contact with the heating roller under pressure. The material 56 passes between the heating roller and the pressure roller to thereby fix the toner image under heating and pressuring onto the transferring material 56. Another fixing method may be used, with which the toner image is fixed by the heater through a film.

Figure 6:
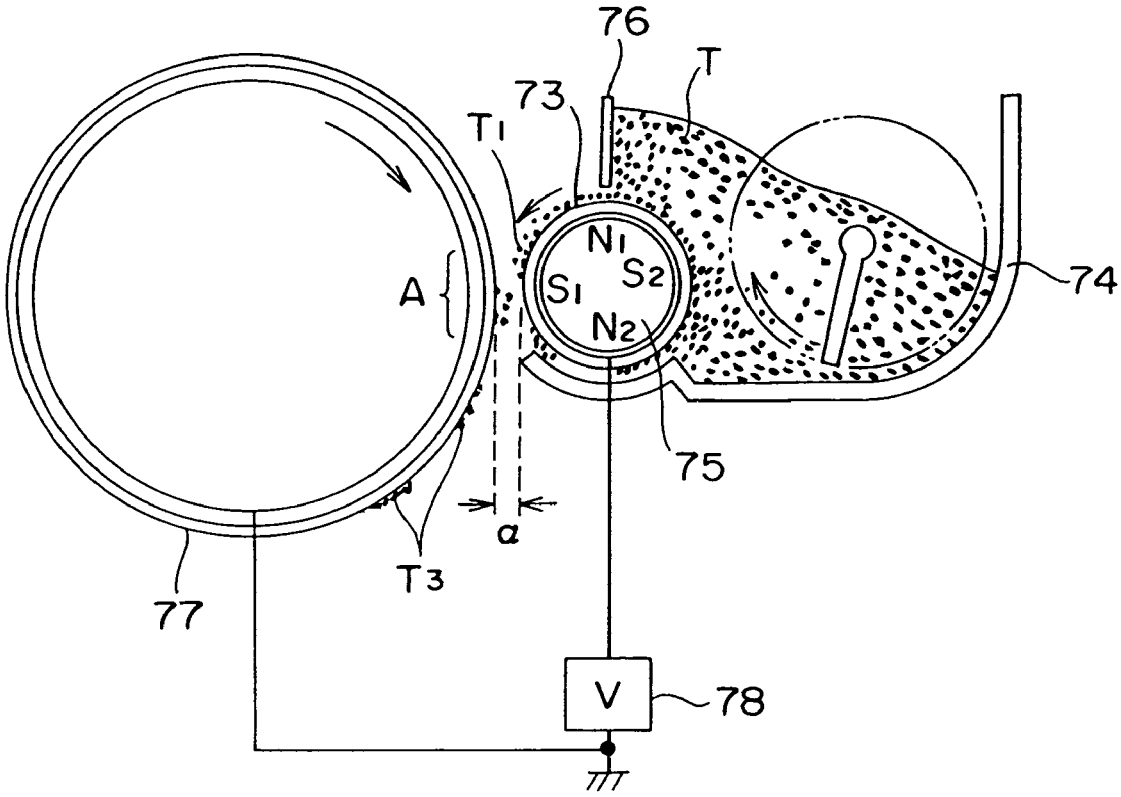
FIG. 6 is a schematic diagram showing a magnetic one-component developing device.

Next, a description will be give of the one-component developing method. The toner.of the present invention is applicable to the one-component developing method such as the magnetic one-component developing method or non-magnetic one-component developing method. Referring to FIG. 6, the magnetic one-component developing method will be described.

In FIG. 6, a developing sleeve 73 has a substantially right half of its peripheral surface in contact with a magnetic toner reserved in a toner container 74 all the time. The magnetic toner in the vicinity of the developing sleeve 73 surface is attracted to adhere to the developing sleeve surface and held thereon by a magnetic force generated by a magnetism generating unit 75 inside the sleeve and/or an electrostatic force. Thereby a magnetic toner layer is formed on the developing sleeve 73. When the developing sleeve 73 is rotated, a magnetic toner layer on the sleeve surface is formed into a thin-layer magnetic toner $T_1$ having the substantially uniform thickness at every portion in the process of passing through a position corresponding to a regulating member 76. The magnetic toner is charged mainly through a frictional contact between the sleeve surface and the magnetic toner existent in the vicinity thereof in the toner container in accordance with the rotation of the developing sleeve 73. The surface of the magnetic toner thin layer on the developing sleeve 73 is rotated toward a latent image bearing member 77 side in accordance with the rotation of the developing sleeve and allowed to pass through a developing region A where the latent image bearing member 77 and the developing sleeve 73 are closest to each other. In the process of passing through the region, DC and AC electric fields generated by applying the DC and AC voltages between the latent image bearing member 77 and the developing sleeve 73 cause magnetic toner particles in the magnetic toner thin layer on the developing sleeve 73 surface to fly. The toner particles reciprocate between the latent image bearing member 77 surface in the developing region A and the developing sleeve 73 surface (gap α). Finally, the magnetic toner on the developing sleeve 73 side selectively moves and adheres to the latent image bearing member 77 surface according to a latent image potential pattern to sequentially form a toner image $T_2$.

The developing sleeve surface of which the magnetic toner is selectively consumed after passing through the developing region A is rerotated toward the reserved toner in the toner container (hopper) 74 and thus supplied with the magnetic toner once more. The surface of the magnetic toner thin layer $T_1$ on the developing sleeve 73 is transported to the developing region A and the developing step is repeatedly performed.

In FIG. 6, the used regulating member 76 as a toner thin layer forming unit is a doctor blade such as a metal blade or a magnetic blade disposed at a given distance from the sleeve. Alternatively, a metal, resin, or ceramic roller may be used instead of the doctor blade. Further, an elastic blade or an elastic roller coming into contact with the developing sleeve (toner bearing member) surface by an elastic force may be used as the toner thin layer forming unit (regulating member).

Preferable examples of materials for the elastic blade or the elastic roller include: rubber elastic materials such as silicone rubber, urethane rubber, and NBR; synthetic resin elastic materials such as polyethylene terephthalate; and metal elastic materials such as stainless steel, steel, and phosphor bronze. Also, a composite thereof may be used. Preferably, a sleeve contact portion is formed of the rubber elastic material or the resin elastic material.

Figure 7:
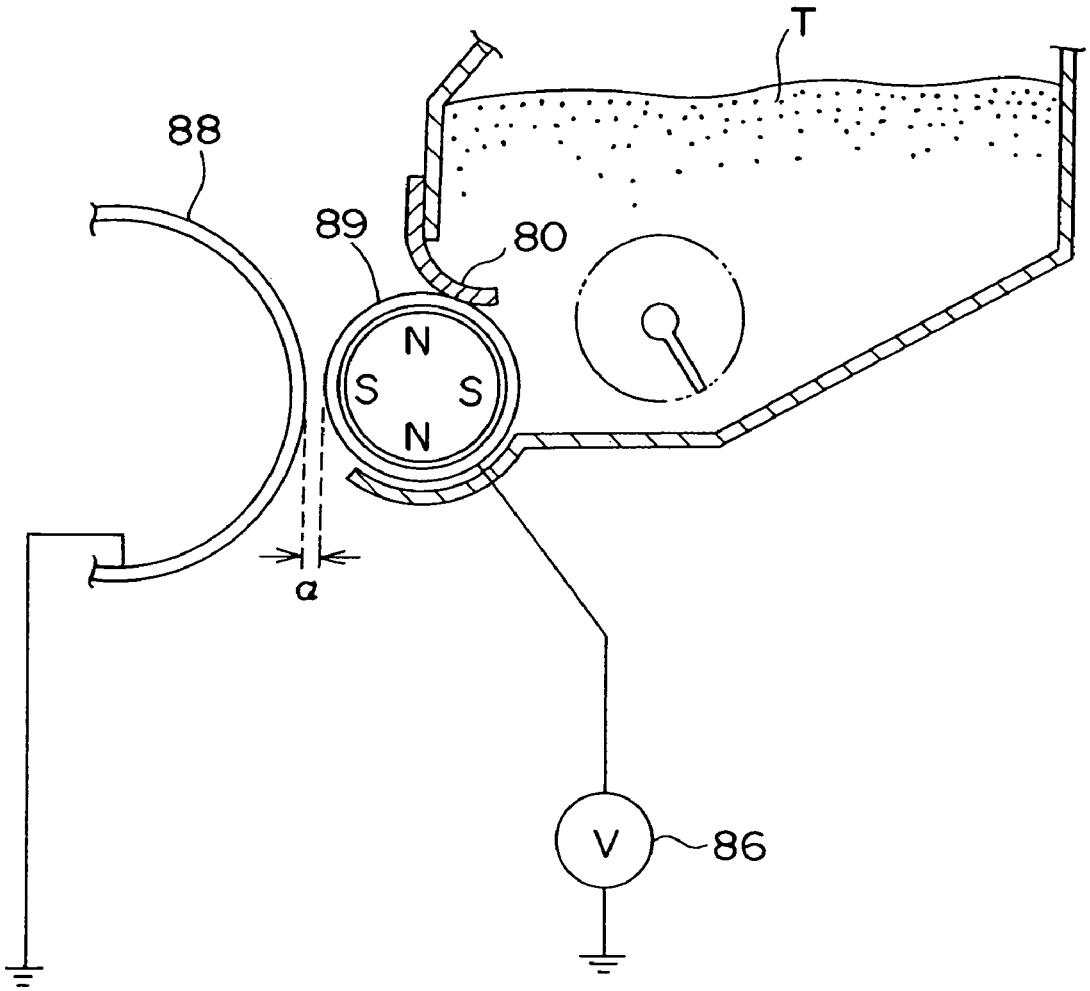
FIG. 7 is a schematic diagram showing a magnetic one-component developing device.

FIG. 7 shows a case of using an elastic blade.

A base portion, which is an upper side of an elastic blade 80, is fixedly held on a developer container side. While a lower side thereof is warped in a forward direction or backward direction of the rotation of a developing sleeve 89 against the elasticity of the blade 80, the inner surface (outer surface in the case of warping in the backward direction) of the blade is brought into contact with the sleeve 89 surface under an appropriate elastic pressure. With such an apparatus, a thinner and denser toner layer can be obtained in a stable manner against the environmental variation.

In the case of using the elastic blade, the toner tends to be fused onto the sleeve or blade surface. The toner of the present invention excels in the releasing property and exhibits a stabilized triboelectricity. Thus, the toner is preferably used.

In the case of the magnetic one-component developing method, the contact pressure between the blade 80 and the sleeve 89 is effectively 0.1 kg/m or more, preferably 0.3 to 25 kg/m, more preferably 0.5 to 12 kg/m as a linear pressure in a generatrix direction of the sleeve. The gap $\alpha$ between the latent image bearing member 88 and the developing sleeve 89 is set to, for example, 50 to 500 μm. The thickness of the magnetic toner layer on the sleeve 89 is most preferably set smaller than the gap $\alpha$ between the latent image bearing member 88 and the developing sleeve 89. However, as needed, the magnetic toner layer may be regulated in its thickness to such a degree that a part of a substantial number of ears of the magnetic toner constituting the magnetic toner layer come into contact with the latent image bearing member 88.

Also, the developing sleeve 89 is rotated at the peripheral speed of 100 to 200% with respect to the latent image bearing member 88. Preferably used is an alternating bias voltage applied by a bias applying unit 86 with a peak-to-peak voltage of 0.1 kV or more, preferably 0.2 to 3.0 kV, more preferably 0.3 to 2.0 kV. An alternating bias frequency is 0.5 to 5.0 kHz, preferably 1.0 to 3.0 kHz, more preferably 1.5 to 3.0 kHz in use. An alternating bias waveform may be a rectangular wave, a sine wave, a sawtooth wave, a triangular wave, etc. Also applicable is an asymmetric AC bias in which forward/backward voltages and/or application periods are different. Also, it is preferable to superimpose the DC bias on the AC bias.

An evaluation method for the respective physical properties of the toner, the developability, the fixability, and the image quality will be described below. Examples mentioned below are based on the following evaluation method.

(1) Measurement of a Toner Charge Amount in Respective Environments:

The toner and the carrier are left to stand all day and night under the respective environmental conditions, after which charge amounts in the respective environments are measured by the following method. A triboelectrification amount of the toner is measured based on a blow-off method, for example, under the conditions of normal temperature/normal humidity (23° C./60% RH); high temperature/high humidity (30° C./80% RH); and low temperature/low humidity (15° C./16% RH).

FIG. 1 is an explanatory view of an apparatus that measures the triboelectrification amount of the toner. First, the mixture of the toner and carrier (mass ratio of 1:19) to be measured of the triboelectrification amount is put in a 50–100 ml polyethylene bottle and shaken manually for 5 to 10 minutes. Then, about 0.5 to 1.5 g of the mixture (developer) is taken therefrom and added to a metal measurement vessel 2 whose bottom is constituted of a 500-mesh-screen 3. The vessel is covered with a metal lid 4. At this point, the total mass of the measurement vessel 2 is measured and represented as $W_1$ (g). Next, a suction operation is performed from a suction port 7 by an aspirator 1 (with at least a contact portion with the measurement vessel 2 formed of an insulator) to control an air flow adjusting valve 6 to set a pressure to 250 mmAq at a vacuum gauge 5. Under such a condition, the suction is performed sufficiently (preferably for 2 minutes) to suck and remove the toner. A potential of an electrometer 9 at this time is represented as V (volt). Here, reference numeral 8 denotes a capacitor and its capacitance is represented by C (μF). After the suction, the total mass of the measurement vessel is measured and represented as $W_2$ (g). The triboelectrification amount (mC/kg) of the toner is calculated by the following equation.

$$\text{Triboelectrification amount (mC/kg) of toner} = (C \times V)/(W_1 - W_2).$$

(2) Measurement of the Triboelectrification Amount of the Toner on the Developing Sleeve:

The triboelectrification amount of the toner on the developing sleeve is measured by a suction type Faraday cage method. The suction type Faraday cage method used herein is as follows. That is, an outer cylinder of the cage is pressed against the developing sleeve surface to suck the toner in a given area on the developing sleeve and collect the toner with the filter in an inner cylinder to thereby measure the increased mass of the filter, thus calculating the mass of the sucked toner from the increased mass of the filter. At the same time, the accumulated charge amount in the inner cylinder electrostatically shielded from the outside is measured, making it possible to measure the triboelectrification amount of the toner on the developing sleeve.

(3) Image Density:

An image density in a fixed image area with a toner mass per unit area of 0.60 mg/cm$^2$ is measured by a densitometer (Macbeth RD918, manufactured by Macbeth Co., Ltd.).

(4) Measurement Method for Degree of Fogging:

A measurement of degree of fogging is performed by use of REFLECTOMETER MODEL TC-6DS manufactured by TOKYO DENSHOKU Co., Ltd. In the case of the cyan toner image, an amber filter is used. The degree of fogging is calculated based on the following equation. The smaller the numerical value, the less the fogging.

Fogging (reflectivity) (%)=(reflectivity of standard paper (%))−(reflectivity of non-image area of sample image (%))

Fog is evaluated at four levels: (A) 1.2% or less; (B) more than 1.2% and 1.6% or less; (C) more than 1.6% and 2.0% or less; and (D) more than 2.0%.

(5) Fixability and Anti-Offset Property:

The external additive is added to the toner particle in an appropriate amount to obtain the toner. The unfixed image of the obtained toner is formed with a commercially available copying machine.

The toner is evaluated of the fixability and the anti-offset property by an external heating roller fixing device with no oil application function. As materials for the roller in this case, an upper roller and a lower roller are both formed of a fluororesin or rubber in their surfaces. The upper and lower rollers both have a diameter of 40 mm in use. As a fixing condition, in the case where the transferring material is SK paper (produced by Nippon Paper Chemicals Co., Ltd.), a nip width is set to 5.5 mm and a fixing rate is set to 200 mm/sec. The fixing operation is performed within a temperature range of 100 to 250° C. while the temperature is controlled every 5° C.

Regarding the fixability, a load of 50 g/cm$^2$ is applied to the image being not offset, which is rubbed with Silbon paper (lens cleaning paper "Desper (trademark)" (produced by Ozu Paper Co., Ltd.) twice to obtain a rate at which the density drops after the rubbing operation from that before the operation. The temperature at which the rate is below 10% is set as a fixing start point.

Regarding the anti-offset property, the temperature at which the offset cannot be visually observed is set as a low-temperature non-offset starting point, and while increasing the temperature, the highest temperature at which the offset does not occur is set as a high-temperature non-offset end point.

(6) Image Quality:

The image quality is comprehensively evaluated based on the uniformity of the image and thin line reproducibility. Note that the uniformity of the image is judged as for the uniformity of the black solid image and the halftone image under the following criteria:

A: Sharp image superior in thin line reproducibility and image uniformity;

B: favorable image although being slightly inferior in thin line reproducibility and image uniformity;

C: allowable image causing no problem in practical use; and

D: image undesirable in practical use with poor thin line reproducibility and image uniformity.

Hereinafer, the present invention will be described based on production examples and examples in more detail. However, the present invention is by no means limited by those examples. Note that parts in the following composition are all parts by mass.

EXAMPLE 1

An aqueous dispersion medium and a polymerizable monomer composition were prepared respectively as described below.

[Preparation of an Aqueous Dispersion Medium]

An aqueous dispersion medium was obtained by finely dispersing 10 parts by mass of calcium phosphate in 500 parts by mass of water and heating to 70° C.

| [Preparation of a polymerizable monomer composition] | |
|---|---|
| Styrene | 90 parts |
| 2-Ethylhexylacrylate | 10 parts |
| Colorant (C.I. Pigment Blue 15:3) | 4 parts |
| Di-t-butylsalicylic metal compound | 1 part |
| Polyester resin (MW = 10,000, AV (acid value) = 8) | 5 parts |
| Ester wax (melting point of 65° C.) | 10 parts |
| Ethylene glycol diacrylate | 0.05 part |

The above components were warmed to 70° C. for sufficient dissolution and dispersion to obtain a polymerizable monomer composition. The polymerizable monomer composition was added into the above-prepared aqueous dispersion medium under high-speed agitating by a high-speed shear-agitator ("CLEARMIX", manufactured by Mtechnique K.K.) to conduct granulation for 10 minutes. 5 parts of di-t-butylperoxide, as a polymerization initiator, was added herein to further conduct granulation for 5 minutes. The monomer conversion at this time was nearly 0%. After granulation, 6 parts of sodium ascorbate, as a reducing agent, was added to obtain a redox initiator. The agitator was replaced by a paddle agitator, and polymerization was continued at an internal temperature of 70° C. After 3 hours of polymerization reaction, an increase of polymerization temperature was started and the temperature was raised to 80° C. in 1 hour. The state was maintained for 5 hours to complete the polymerization. After the completion of the polymerization reaction, distillation was conducted under a reduced pressure and a part of a reaction liquid was distilled off. After cooling, a dispersant was dissolved by adding diluted hydrochloric acid, and the mixture was subjected to a liquid-solid separation, washed with water, filtered, and dried, to thereby obtain a polymerization toner particle.

Figure 2:
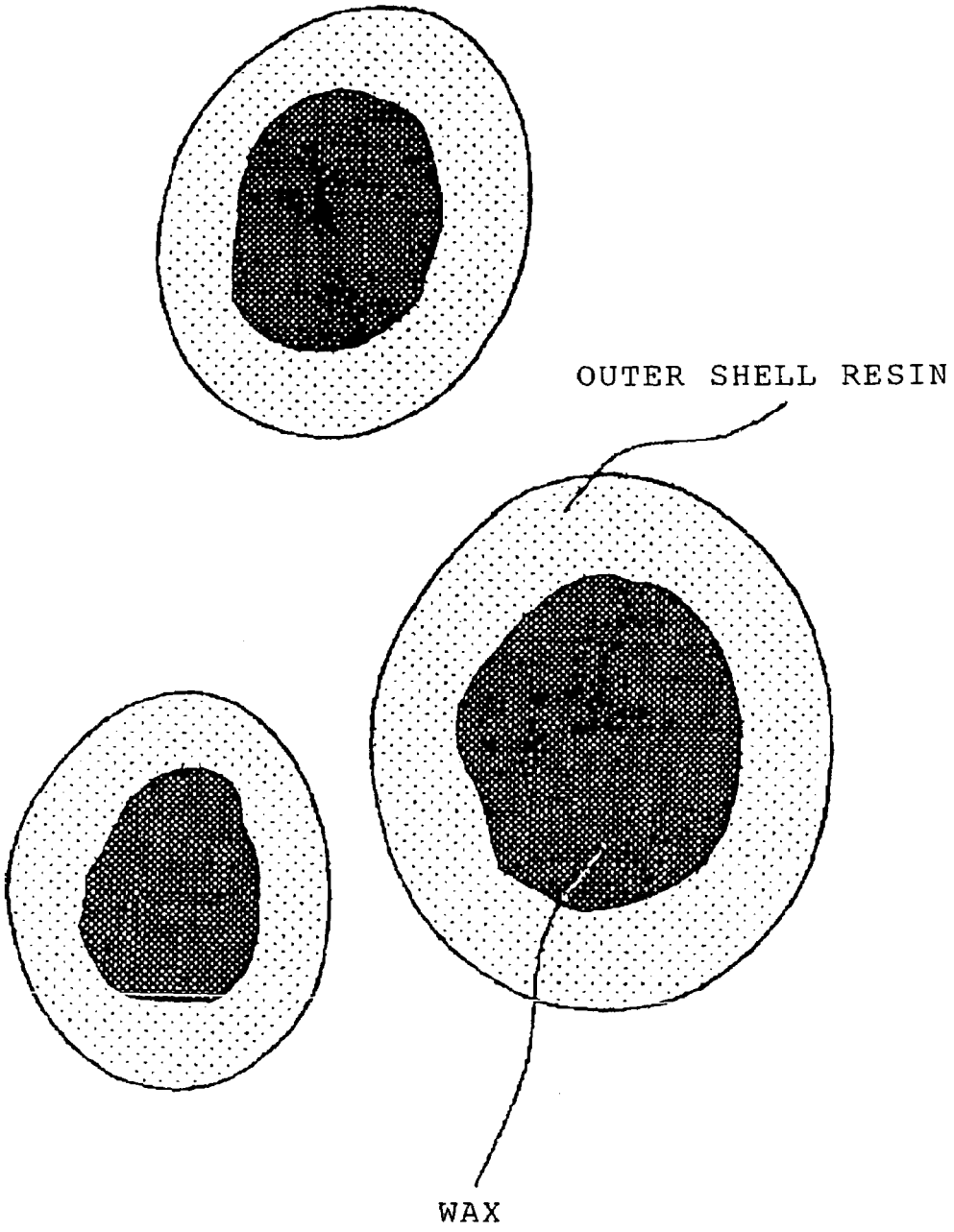
FIG. 2 is a schematic diagram of a cross section of a toner particle in which a wax is encapsulated in an outer shell resin.

By observing a cross section of the cyan toner particle by TEM, a favorable encapsulation of a wax by an outer shell resin could be confirmed as shown in FIG. 2.

100 parts of the thus-obtained cyan toner particle was blended with 1.5 parts of hydrophobic silica fine particles, prepared by treating silica having a primary particle diameter of 9 nm with hexamethyldisilazane and then with a silicone oil so that the BET value after treatments becomes 200 m$^2$/g, to thereby obtain a negative triboelectric Cyan Toner 1.

To 6 parts of the Cyan Toner 1, 94 parts of ferrite carrier coated with the acrylic resin was blended to prepare a developer. Using a commercially available digital full-color copying machine (CLC500, manufactured by CANON INC.) remodeled by removing an oil application mechanism of a fixing device as shown in FIG. 4, a continuous copying tests on 10,000 sheets for the Cyan Toner 1 (under high temperature and high humidity environments) was performed. Physical properties and evaluation results of the toner are shown in Tables 1 and 2.

EXAMPLES 2 TO 4

The colorant of Example 1 was replaced by C.I. Pigment Yellow 180, C.I. Pigment Red 122, and carbon black to obtain a Yellow Toner 2, a Magenta Toner 3, and a Black Toner 4, respectively, by conducting the same procedures to Example 1. By observing cross sections of toner particles by TEM, favorable encapsulations of waxes by outer shell resins could be confirmed as shown in FIG. 2. Physical properties and evaluation results of the toners are shown in Tables 1 and 2.

The toners of Examples 1 to 3 exhibited favorable properties as shown in the results of Table 2, but in Example 4, a slight image deterioration from a decrease of a charge amount after running was confirmed, which was considered to result from an influence of polymerization inhibition by carbon black.

EXAMPLE 5

The same procedure as Example 1 was conducted except that the reducing agent of Example 1 was replaced by dimethylaniline to obtain a Cyan Toner 5. By observing a cross section of a toner particle by TEM, a favorable encapsulation of a wax by an outer shell resin could be confirmed as shown in FIG. 2. Physical properties and evaluation results of the toner are shown in Tables 1 and 2. A slight fog and image deterioration from a decrease of a charge amount in running were confirmed because dimethylaniline, containing a nitrogen atom, was used as the reducing agent.

EXAMPLE 6

[Production of Surface-Treated Magnetic Particles]

Into a ferrous sulfate aqueous solution, a sodium hydroxide solution in an amount of 1.0 to 1.1 equivalents of a ferrous ion was added and blended therewith to prepare an aqueous solution containing ferrous hydroxide.

While maintaining the pH of the aqueous solution at about 9, air was blown therein to conduct an oxidation reaction at 80 to 90° C., to thereby prepare a slurry liquid for forming a seed crystal.

Next, to the slurry liquid, a ferrous sulfate aqueous solution in an amount of 0.9 to 1.2 equivalents of the initial amount of alkaline (sodium component of sodium hydroxide) was added, the pH was maintained at about 8, and an oxidation reaction was conducted while blowing in air. After the oxidation reaction was completed, a obtained magnetic iron oxide particle was washed, filtered, and once taken out. At this time, a small amount of a water-containing sample was taken in a to determine water content thereof. Then, the water-containing sample was re-dispersed in another aqueous medium without drying. While adjusting the pH of the re-dispersion liquid at about 6 under sufficient agitating, a silane coupling agent ($n\text{-}C_4H_{13}Si(OCH_3)_3$) in an amount of 3.0 parts with respect to 100 parts of the magnetic iron oxide (the amount of the magnetic iron oxide is assumed to be calculated by subtracting the water content from the water-containing sample) was added to the re-dispersion liquid to effect coupling treatment. The resultant hydrophobic iron oxide particles were then washed, filtered, and dried, followed by disintegration of slightly agglomerated particles, by conventional methods, to obtain the surface-treated magnetic particles having an average particle diameter of 0.18 μm.

[Preparation of Magnetic Toner 6]

Into 709 g of deionized water, 451 g of 0.1 M-$Na_3PO_4$ aqueous solution was added, and after warming to 60° C., 67.7 g of 1.0 M-$CaCl_2$ aqueous solution was added thereto, to obtain an aqueous medium containing $Ca_3(PO_4)_2$.

| | |
|---|---|
| Styrene | 90 parts |
| 2-Ethylhexyl acrylate | 10 parts |
| Triethylene glycol dimethacrylate | 1.0 part |
| Polyester resin (Mw = 10,000, AV = 7) | 5 parts |
| Salicylic metal compound | 1 part |
| Surface-treated magnetic particles | 85 parts |

The above ingredients were uniformly dispersed and blended using an attritor (manufactured by Mitsui Miike Machinery Co., Ltd.).

The thus-obtained monomer composition was warmed to 60° C., and 12 parts of an ester wax having a DSC endothermic peak temperature of 80° C. was added, blended, and dissolved. 5 parts by mass of t-butylperoxyisopropyl monocarbonate, as an organic peroxide of a redox initiator as a polymerization initiator, was dissolved in the mixture.

The thus-obtained polymerizable monomer system was charged into the above-prepared aqueous medium and agitated in a $N_2$ atmosphere at 60° C. for 15 minutes at 10,000 rpm by a TK homomixer (manufactured by Tokushu Kika Kogyo K.K.) for granulation. The monomer conversion was nearly 0% at this point. Then, while agitating with a paddle agitator, 7 parts of sodium ascorbate, as a reducing agent of the redox initiator, was added. After conducting the reaction at 60° C. for 2 hours, the liquid temperature was raised to 80° C. in 2 hours, and agitation was continued for 8 more hours. After the reaction, distillation was conducted. The suspension was cooled, and hydrochloric acid was added thereto to dissolve the dispersant. Then, the suspension was filtered, washed with water, and dried to obtain a polymerization magnetic toner particle.

100 parts of the thus-obtained magnetic toner particles were blended with 1.0 part of hydrophobic silica fine particles, prepared by treating silica having a primary particle diameter of 9 nm with hexamethyldisilane and then with a silicone oil so that the BET value after treatments was 200 $m^2/g$, to thereby obtain a Magnetic Toner 6.

Using the Magnetic Toner 6 and an image forming apparatus shown in FIG. 8 explained hereinafter, a 10,000-sheet continuous copying (under the high temperature and high humidity environment) test was performed.

Figure 8:
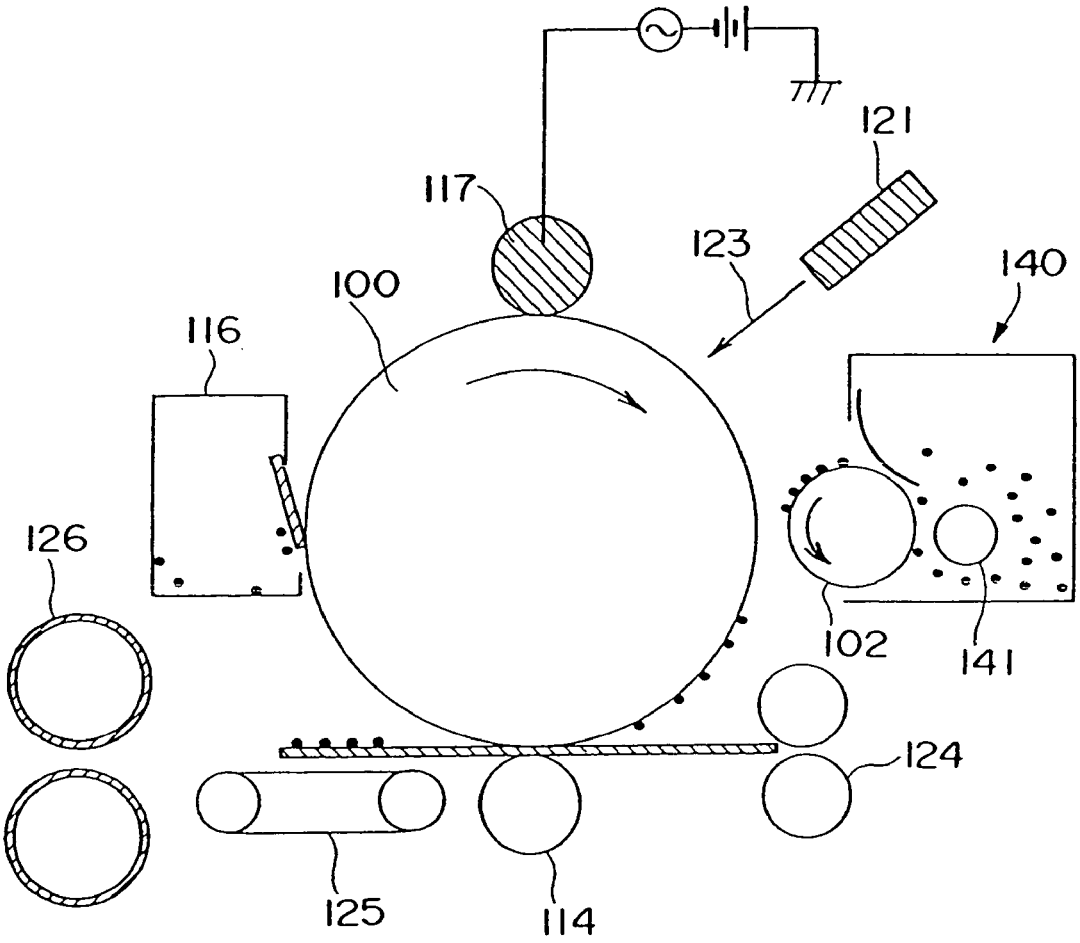
FIG. 8 is a schematic diagram showing an image forming apparatus employing a magnetic one-component developing device.

The image forming apparatus shown in FIG. 8 is that employing a magnetic one-component developing method, which comprises: a photosensitive drum 100 as an image bearing member; a charging roller 117 as a charging unit; an image exposure unit 121 which irradiate a laser beam 123; a magnetic one-component developing device 140 having an agitating unit 141 for agitating a toner and a developing sleeve 102 which bears the toner thereon and carries the toner to the photosensitive drum 100; a transferring material transport units 124 and 125; a transfer unit 114; a fixing unit 126; and cleaning unit 116.

Physical properties and evaluation results of the Magnetic Toner 6 are shown in Tables 1 and 2. As shown in Table 2, the toner had favorable toner properties.

EXAMPLE 7

In Example 6, the aqueous medium containing $Ca_3(PO_4)_2$ was replaced by an aqueous medium obtained by including 1 g of polyvinyl alcohol in 1200 g of deionized water, and granulation was completed by conducting the same procedures. 6 parts of sodium ascorbate, as a reducing agent of a redox initiator, was added. Then, the same procedure as Example 6 was conducted using a paddle agitator instead. However, stability of particles was inferior, and the particles tended to coalesce, which supposedly resulted from the use of polyvinyl alcohol as a dispersant. Therefore, agitating speed was raised to obtain a polymerization toner particle.

To 100 parts of the toner, 1.0 part of silica used for the Magnetic Toner 6 was added and blended to obtain a Magnetic Toner 7. Using the Magnetic Toner 7 and an image forming apparatus employing a magnetic one-component developing device shown in FIG. 8, a 10,000-sheet continuous copying (under the high temperature and high humidity environment) test was performed. Physical properties and evaluation results of the Magnetic Toner 7 are shown in Tables 1 and 2. The toner had a rather small average circularity and mode circularity, and therefore was rather inferior in fixability. Further, in print out evaluation, the toner was rather inferior in fogging and image quality after running.

EXAMPLES 8 AND 9

The operation of Example 1 was repeated except for changing the distillation condition to obtain Cyan Toners 8 and 9 with different t-butanol contents. By observing cross sections of the toner particles by TEM, favorable encapsulations of waxes by outer shell resins could be confirmed as shown in FIG. 2. Physical properties and evaluation results of the toners are shown in Tables 1 and 2. The toner of Example 8 had a rather small t-butanol content, and therefore was rather inferior in fixability. The toner of Example 9 had a rather large t-butanol content, and therefore involved a slight fogging and deterioration of the image quality in the latter half of the print out running.

EXAMPLE 10

Figure 5:
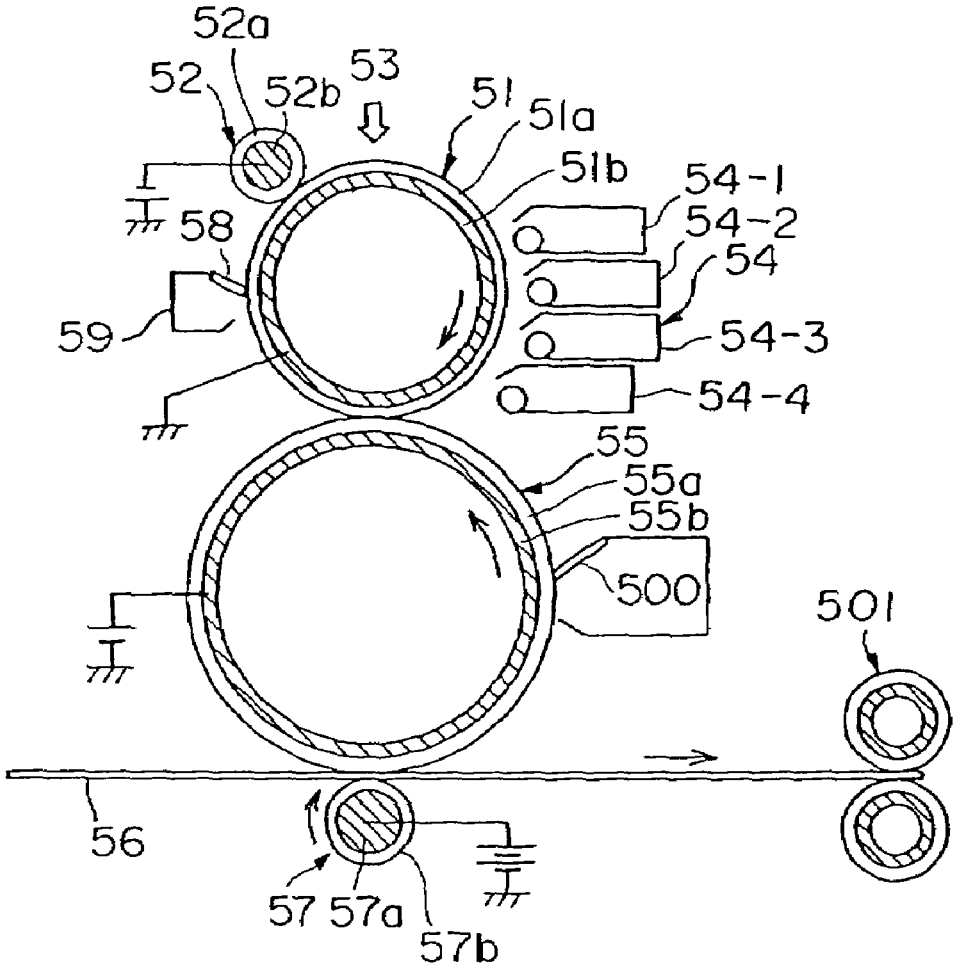
FIG. 5 is a schematic diagram showing an image forming apparatus using an intermediate transfer member.

Using the toner used in Example 1 and an image forming apparatus employing a nonmagnetic one-component developing device as shown in FIG. 5, a full-color, 5,000-sheet continuous copying test (under high temperature, high humidity environment) was performed. A stable image quality with solid image uniformity was obtained.

COMPARATIVE EXAMPLE 1

A Cyan Toner 10 was prepared in the same manner as in Example 1 except that the polymerization initiator is changed to 4 parts of lauroyl peroxide (10-hour half-life temperature of 61.6° C.) and the reducing agent is not used. By observing the cross section of the toner particles by TEM, a favorable encapsulation of a wax by an outer shell resin could be confirmed as shown in FIG. 2. Physical properties and evaluation results of the toner are shown in Tables 1 and 2. The fixability of the toner was inferior to that of the toner of the Example 1.

TABLE 1

| Toner | Organic peroxide | Reducing agent | Content of t-BuOH (ppm) | D4 of toner (μm) | D4/D1 | Average circularity | Mode circularity | Peak molecular weight | Rate of liberation of silica(%) |
|---|---|---|---|---|---|---|---|---|---|
| 1 | Di-t-butylperoxide | Sodium ascorbate | 50 | 6.8 | 1.21 | 0.983 | 1.00 | 25,000 | 0.25 |
| 2 | Di-t-butylperoxide | Sodium ascorbate | 30 | 7.2 | 1.22 | 0.982 | 1.00 | 24,000 | 0.26 |
| 3 | Di-t-butylperoxide | Sodium ascorbate | 80 | 7 | 1.20 | 0.982 | 1.00 | 24,500 | 0.24 |
| 4 | Di-t-butylperoxide | Sodium ascorbate | 150 | 7.1 | 1.23 | 0.980 | 1.00 | 26,000 | 0.22 |
| 5 | Di-t-butylperoxide | Dimethyl alanine | 60 | 6.8 | 1.21 | 0.982 | 1.00 | 25,000 | 0.24 |
| 6 | t-Butylperoxyisopropyl monocarbonate | Sodium ascorbate | 300 | 6.5 | 1.20 | 0.982 | 1.00 | 24,000 | 0.25 |
| 7 | t-Butylperoxyisopropyl monocarbonate | Sodium ascorbate | 250 | 6.9 | 1.28 | 0.972 | 0.96 | 24,000 | 0.26 |
| 8 | t-Butyl hydroperoxide | Sodium ascorbate | 0.08 | 6.8 | 1.21 | 0.982 | 1.00 | 25,000 | 0.28 |
| 9 | t-Butyl hydroperoxide | Sodium ascorbate | 1100 | 6.9 | 1.22 | 0.980 | 1.00 | 25,000 | 0.26 |
| 10 | Lauroyl peroxide | None | Not detected | 6.9 | 1.21 | 0.982 | 1.00 | 24,000 | 0.28 |

TABLE 2

| | | Initial stage | | | | After print-out running | | | | Fixation | Offset |
|---|---|---|---|---|---|---|---|---|---|---|---|
| | Toner | Image density | Fogging | Charge amount (mC/kg) | Image quality | Image density | Fogging | Charge amount (mC/kg) | Image quality | starting temperature (° C.) | occurrence temperature (° C.) |
| Example 1 | 1 | 1.49 | A | −23 | A | 1.48 | A | −24 | A | 130 | 220 |
| Example 2 | 2 | 1.48 | A | −22 | A | 1.47 | A | −23 | A | 130 | 220 |

TABLE 2-continued

| | | Initial stage | | | | After print-out running | | | | Fixation | Offset |
|---|---|---|---|---|---|---|---|---|---|---|---|
| | Toner | Image density | Fogging | Charge amount (mC/kg) | Image quality | Image density | Fogging | Charge amount (mC/kg) | Image quality | starting temperature (° C.) | occurrence temperature (° C.) |
| Example 3 | 3 | 1.49 | A | −24 | A | 1.49 | A | −22 | A | 130 | 220 |
| Example 4 | 4 | 1.45 | A | −18 | A | 1.43 | A | −16 | B | 130 | 220 |
| Example 5 | 5 | 1.46 | A | −16 | A | 1.42 | B | −13 | B | 130 | 220 |
| Example 6 | 6 | 1.45 | A | −18 | A | 1.46 | A | −18 | A | 140 | 220 |
| Example 7 | 7 | 1.45 | A | −19 | A | 1.39 | B | −14 | B | 145 | 220 |
| Example 8 | 8 | 1.48 | A | −22 | A | 1.49 | A | −24 | A | 145 | 220 |
| Example 9 | 9 | 1.49 | A | −23 | A | 1.42 | B | −20 | B | 130 | 220 |
| Comparative Example 1 | 10 | 1.48 | A | −22 | A | 1.05 | A | −23 | A | 150 | 220 |

By using the toner of the present invention, an image having favorable fixability, excellent in charge stability, and retaining high image density and high resolution in long-term use can be obtained.

What is claimed is:

1. A toner obtained by polymerizing a polymerizable monomer composition comprising at least a polymerizable monomer, a wax and a colorant, wherein:

the polymerizable monomer composition is polymerized using a polymerization initiator comprising a redox initiator which comprises an organic peroxide with a 10-hour half-life temperature of 86° C. or higher and a reducing agent;

the toner has a ratio of a weight-average particle diameter to a number-average particle diameter (weight average particle diameter/number-average particle diameter) of 1.40 or less;

the toner has top of a main-peak in a molecular weight range of 5,000 to 50,000 in a molecular weight distribution measured using a gel permeation chromatography (GPC) of a THF-soluble part thereof; and the toner contains t-butanol with a content of 0.1 to 1,000 ppm.

2. The toner according to claim 1, wherein the reducing agent is an organic compound which does not comprise a sulfur atom or a nitrogen atom.

3. The toner according to claim 1, wherein the reducing agent is an ascorbic acid or an ascorbate.

4. The toner according to claim 1, wherein the organic peroxide is selected from the group consisting of t-butylhydroperoxide, d-t-butylperoxide, and t-butylperoxideisopropyl monocarbonate.

5. The toner according to claim 1, wherein 1 to 30% by mass of the wax is contained with respect to a binder resin.

6. The toner according to claim 1, wherein the toner has a mode circularity of 0.99 or more.

7. The toner according to claim 1, wherein the wax has an endothermic peak measured by a differential thermal analysis in a range of 40° C. to 150° C.

8. The toner according to claim 1, further comprising an inorganic fine particle having a number-average primary particle diameter of 4 to 100 nm on a surface of the toner.

9. The toner according to claim 8, wherein the inorganic fine particle comprises at least one selected frm the group consisting of silica, titanium oxide, and alumina.

10. The toner according to claim 8, wherein a rate of liberation of the inorganic fine particle from the toner is 0.1 to 2.0%.

11. The toner according to claim 1, wherein the colorant comprises a chromatic colorant.

12. The toner according to claim 1, further comprising a magnetic substance.

13. A toner according to claim 1, wherein the toner has an average circularity of 0.970 or more.

* * * * *

UNITED STATES PATENT AND TRADEMARK OFFICE

CERTIFICATE OF CORRECTION

PATENT NO. : 7,070,898 B2
APPLICATION NO. : 10/726503
DATED : July 4, 2006
INVENTOR(S) : Tatsuya Nakamura et al.

It is certified that error appears in the above-identified patent and that said Letters Patent is hereby corrected as shown below:

COLUMN 1:

Line 34, “latent,” should read --latent--.

COLUMN 7:

Line 22, “9 μ.” should read --9 μm.--.

COLUMN 10:

Line 30, “by.accordingly” should read --by accordingly--; and
Line 31, “crosslinking.agent,” should read --crosslinking agent,--.

COLUMN 16:

Line 29, “advance,.” should read --advance,--.

COLUMN 23:

Line 7, “sleeve 3” should read --sleeve 31--.

COLUMN 26:

Line 50, “kv).” should read --kV).--.

COLUMN 28:

Line 29, “toner.of” should read --toner of--.

UNITED STATES PATENT AND TRADEMARK OFFICE

CERTIFICATE OF CORRECTION

PATENT NO. : 7,070,898 B2
APPLICATION NO. : 10/726503
DATED : July 4, 2006
INVENTOR(S) : Tatsuya Nakamura et al.

It is certified that error appears in the above-identified patent and that said Letters Patent is hereby corrected as shown below:

COLUMN 38:

Line 20, "d-t-butylperoxide," should read --di-t-butylperoxide,--; and "t-butylperoxideisopro-" should read --t-butylperoxyisopro- --.

Signed and Sealed this

Fourth Day of September, 2007

JON W. DUDAS
*Director of the United States Patent and Trademark Office*